US007413839B2

(12) United States Patent
Matsumoto et al.

(10) Patent No.: US 7,413,839 B2
(45) Date of Patent: Aug. 19, 2008

(54) TONER, DEVELOPER, TONER CONTAINER, PROCESS CARTRIDGE, AND AN IMAGE FORMING APPARATUS

(75) Inventors: Keiko Matsumoto, Susono (JP); Toyoshi Sawada, Odawara (JP)

(73) Assignee: Ricoh Company, Ltd., Tokyo (JP)

( * ) Notice: Subject to any disclaimer, the term of this patent is extended or adjusted under 35 U.S.C. 154(b) by 412 days.

(21) Appl. No.: 11/081,737

(22) Filed: Mar. 17, 2005

(65) Prior Publication Data

US 2005/0214670 A1 Sep. 29, 2005

(30) Foreign Application Priority Data

Mar. 18, 2004 (JP) ..... 2004-078359
Mar. 2, 2005 (JP) ..... 2005-057861

(51) Int. Cl.
*G03G 9/087* (2006.01)

(52) U.S. Cl. ..... 430/109.4; 430/109.1; 430/124.1; 399/159

(58) Field of Classification Search ..... 430/109.4, 430/109.1, 124, 124.1; 399/159
See application file for complete search history.

(56) References Cited

U.S. PATENT DOCUMENTS

| | | | | |
|---|---|---|---|---|
| 5,057,392 | A | 10/1991 | McCabe et al. | |
| 6,821,698 | B2 | 11/2004 | Sawada et al. | |
| 2003/0039910 | A1* | 2/2003 | Shirai et al. | 430/109.4 |
| 2003/0129518 | A1* | 7/2003 | Sawada et al. | 430/109.4 |
| 2003/0219670 | A1 | 11/2003 | Sawada et al. | |
| 2004/0157147 | A1 | 8/2004 | Shiraishi et al. | |
| 2004/0234879 | A1 | 11/2004 | Hasegawa et al. | |

FOREIGN PATENT DOCUMENTS

| | | |
|---|---|---|
| JP | 2001-343780 | 12/2001 |
| JP | 2002-108018 | 4/2002 |

(Continued)

OTHER PUBLICATIONS

Patent Abstracts of Japan, JP 01-035454, Feb. 6, 1989.

(Continued)

*Primary Examiner*—John L Goodrow
(74) *Attorney, Agent, or Firm*—Oblon, Spivak, McClelland, Maier & Neustadt, P.C.

(57) ABSTRACT

The object of the present invention is to provide a toner characterized in that the toner comprises a first binder resin and a second binder resin, the first binder resin is an amorphous resin and the second binder resin is a crystalline resin, and the glass-transition temperature of the toner (TgA) is lower than the glass-transition temperature expressed by the following equation (1) (TgC).

$$TgC = \sum_{i=1}^{n} b_i \Big/ \sum_{i=1}^{n} \left( \frac{b_i}{TgB_i} \right) \qquad \text{Equation (1)}$$

In the above equation (1), "$TgB_i$" represents the glass-transition temperature of the amorphous resin, "n" represents the number of amorphous resins, and "b" represents the content of the amorphous resin (part by mass). Examples of the preferred aspect of the present invention includes the one that at least a part of the amorphous resin and a part of the crystalline resin are compatible each other, and the one that the glass-transition temperature of the toner (TgA) is 10° C. or more lower than the glass-transition temperature (TgC).

22 Claims, 12 Drawing Sheets

FOREIGN PATENT DOCUMENTS

| | | |
|---|---|---|
| JP | 2002-214831 | 7/2002 |
| JP | 2003-167384 | 6/2003 |

OTHER PUBLICATIONS

Derwent Publications, AN 1981-52666D, XP-002331280, JP 56-065146, Jun. 2, 1981.

U.S. Appl. No. 11/687,875, filed Mar. 19, 07, Kojima, et al.
U.S. Appl. No. 11/687,404, filed Mar. 16, 2007, Seshita, et al.
U.S. Appl. No. 11/756,194, filed May 31, 2007, Matsumoto, et al.
U.S. Appl. No. 11/855,806, filed Sep. 14, 2007, Awamura, et al.
U.S. Appl. No. 11/856,379, filed Sep. 17, 2007, Sawada, et al.

* cited by examiner

TONER, DEVELOPER, TONER CONTAINER, PROCESS CARTRIDGE, AND AN IMAGE FORMING APPARATUS

BACKGROUND OF THE INVENTION

1. Field of the Invention

The present invention relates to a toner which is preferably used for an electrophotography, an electrostatic recording process, an electrostatic printing process and the like. Moreover, the present invention relates to a developer using the toner, a toner container, a process cartridge, a fixing process, an image forming apparatus, and an image forming process.

2. Description of the Related Art

As a fixing process used for dry developing process, a heat roller process is widely employed because of its excellent energy efficiency. To improve energy saving through low temperature fixing of a toner in recent years, heat energy given to a toner when fixing the toner tends to be lowered. In the DSM (Demand-side Management) program of the International Energy Agent (IEA) in 1999, in the case of a copier having a copying speed (CPM) of 30 or more, the performance that the standby time is within 10 seconds and the standby power consumption is 10 watt or less (depends on the copying speed) is required, and an achievement of the energy saving has become an extremely important subject.

As an achievement of the energy saving, a process for making the thermal heat capacity of a fixing member such as a heating roller lowered to improve the temperature-responsiveness of the toner is considered. However, the process is not a process fully enough to satisfy the realization of energy saving. Also, for the purpose of minimizing the standby time, a process for making the fixing temperature of a toner itself lowered to get the toner fixing temperature in use lowered is considered. As a process for making fixing a toner at low temperature as described above, for example, there have been processes presented, which use a specific non-olefin crystalline polymer or a crystalline polyester as binder resins in which the glass-transition temperature have sharp melt properties.

The resins having crystalline properties as above, however, may not make a toner fixed at low temperature depending on the combination of a resin with other resins which constitutes the toner. In addition, just the use of the crystalline resin only enables fixing a toner at low temperature but causes a problem that hot offset phenomena and blocking phenomena occur. Further, when a crystalline resin having sharp melt properties is kneaded, and if the crystalline resin content of the toner is too high, the melting viscosity has become extremely lowered, and this easily prevents the dispersion of the colorants and mold releasants contained in the toner. The unevenness of dispersion of colorants causes degradation of the degree of pigmentation, and there may be cases where a high-density image cannot be obtained. Besides, if a full-color toner is used, clear images may not be obtained. Also, when a colorant is made from a low-resistive substance such as a carbon, and when the colorant in the toner is in a poor dispersion condition, this may decrease the toner resistivity to cause background smear of images (blushing) due to degradation of developing performance and uneven toner density in solid portions due to degradation of transferring properties. Besides, the uneven dispersion of releasants will raise the existence rate of wax on the toner surface, which will, as in the case with unevenness of dispersion of colorants, cause negative effects due to degradation of developing performance. Further, with time lapse, if a two-component developer is used, the releasant will be melted and attached to the carrier, and if a one-component developer is used, the releasant will be melted and attached to the charge roller and the blade. Therefore, there is a problem that the durability of the toner becomes worse.

In addition, there have been strong demands for high-quality images. For the realization of high-quality images, toner's smaller sizing (namely, smaller diameter of toner particle) is effective, but the smaller a toner particle diameter becomes, the easier a problem with deterioration of dispersion of each component constituting the toner is suffered, and toner blushing and toner scattering stand out. Hence, in view of toner's smaller sizing, it is required to include a crystalline resin to a toner without any deterioration of dispersion conditions of each component constituting the toner.

For instance, Japanese Patent Laid-Open (JP-A) No. 2002-108018 discloses a toner in which low-temperature toner fixability is improved by making the toner include a binder resin containing a crystalline resin having at least one melting point (specifically a crystalline polyester resin).

Also, Japanese Paten Laid-Open (JP-A) No. 2002-214831 discloses an image forming process in which a toner's low-temperature fixability is improved by using a toner mainly maid from a crystalline polyester resin as a binder resin.

However, the toners above may cause the above-mentioned problems attributable to unevenness of colorants and releasants in their toners if melted and kneaded, because a crystalline polyester resin is used as the major component in the binder resins of the toners.

In addition, for example, Japanese Patent Application Laid-Open (JP-A) No. 2003-167384 describes a toner which contains both a crystalline resin and an amorphous resin as the binder resin and these resins are incompatible each other, and defines the relation of softening points of the crystalline resin and the amorphous resin. However, although the technology enables obtaining a toner contributing to fixing an image at lower temperature by means of the sharp melt properties of the crystalline resin, the blocking resistivity may worsen, and it is difficult to balance the fixing an image at lower temperature with the blocking resistivity.

Thus, there have not yet been presented a toner that excels in various properties such as charge properties, transferring properties, and fixability, has excellent hot offset resistivity, and is capable of balancing excellent blocking resistivity and low-temperature fixability to allow obtaining high-quality images, and the related art using such a toner, under the present situation.

SUMMARY OF THE INVENTION

It is an object of the present invention to solve various problems in the related art and to provide a toner having excellence in various properties such as charge properties, transferring properties, and fixability, having excellent hot offset resistivity, and capable of balancing excellent blocking resistivity and low-temperature fixability to allow high-quality image as well as to provide a developer using the toner to allow high-quality images, a toner container, a process cartridge, a fixing process, an image forming apparatus, and an image forming process.

As a result of repeated keen examinations in view of the problems stated above, the inventors of the present invention found that containing an amorphous resin and a crystalline resin to a toner as binder resin to make these resins compatible one another makes it possible to decrease the grass-transition temperature of toner (Tg) and is effective in low-temperature fixing of toner. It is also found that the decreasing degree of grass-transition temperature (Tg) of toner differs depending on the combination of resins constituting the binder resin, and there are combinations which make low-temperature fixing easy. These findings lead to the accomplishment of the present invention.

The present invention is based on the above noted findings by the inventors, and the processes to solve the above-noted problems are as follows:

A first aspect of the present invention is a toner which comprises a first binder resin and a second binder resin, wherein the first binder resin is an amorphous resin and the second binder resin is a crystalline, and the grass-transition temperature (TgA) of the toner is lower than the grass-transition temperature (TgC) expressed by the following equation (1):

$$TgC = \sum_{i=1}^{n} b_i \Big/ \sum_{i=1}^{n} \left( \frac{b_i}{TgB_i} \right) \qquad \text{Equation (1)}$$

In the equation (1) above, "$TgB_i$" represents the glass-transition temperature of the amorphous resin, "n" represents the number of amorphous resins, and "b" represents the content of the amorphous resin (part by mass).

In a toner of the first aspect of the present invention, the melting viscosity of the toner decreases even at low temperature, the toner can be sufficiently fixed even at low temperature because of a sharp decrease in the melting viscosity to the temperature, since the binder resin comprises an amorphous resin and a crystalline resin. In addition, low-temperature fixing of toner is easily realizable, because the glass-transition temperature of the toner (TgA) is lower than the glass-transition temperature (TgC) expressed by the equation (1) above. Hence, it is possible to realize favorable hot-offset resistivity and balance excellent blocking resistivity and low-temperature fixability to form high quality images.

It is preferable that at least a part of the amorphous resin and a part of the crystalline resin are compatible each other. If at least a part of the amorphous resin and a part of the crystalline resin are compatible each other, a decrease in the glass-transition temperature of the toner (TgA) can be easily done.

It is also preferable that the glass-transition temperature (TgA) is 10° C. or more lower than the glass-transition temperature (TgC) expressed by the equation (1). If the glass-transition temperature (TgA) is 10° C. or more lower than the glass-transition temperature (TgC), the toner can be sufficiently fixed even at low temperature, and low-temperature fixing of the toner can be easily achieved.

Also, it is preferable that an endothermic peak of the crystalline polyester origin exists on the endothermic curve of DSC (differential scanning calorimetry) of the toner. Because portions holding crystalline substances apparently exist in the toner, the blocking resistivity can be ensured, and balancing low-temperature fixability with blocking resistivity can be easily.

It is also preferable that the crystalline resin is a polyester resin containing the constitutional unit expressed by the following formula (1):

$$[\text{—OOC—R—COO—}(CH_2)_n\text{—}] \qquad \text{Formula (1)}$$

In the above formula, "R" represents a divalent hydrocarbon group having the number of carbons of 2 to 20, and "n" represents the number of the repeating units from 2 to 20.

It is preferred that "R" in the above formula (1) is a divalent hydrocarbon group of straight chain unsaturated aliphatic series. In this aspect, the toner becomes to have high sharp melt properties to thereby sufficiently fixed even at low temperature.

It is also preferable that the content of the crystalline resin in the binder resin is 50% by mass or less. If the crystalline resin content to the binder resin is 50% by mass or less, the toner excels in charge properties and transferring properties.

The melting point of the crystalline resin is also preferably 80° C. to 130° C. If the melting point of the crystalline resin is within the given range of temperature, a balance between excellent blocking resistivity and low-temperature fixability can be achieved to allow forming high quality images.

It is also preferred that a x-ray diffracted peak of the crystalline resin in the x-ray diffraction pattern by means of a powder x-ray diffractometer, the diffracted peak exists at least at a position of 2θ=20° to 25°.

It is also preferred that the glass-transition temperature of the amorphous resin (TgB) is 40° to 70°, and the softening point (F1/2) is preferably 120° to 160°. If the glass-transition temperature (TgB) and the softening point (F1/2) are both in the given numerical ranges, it is possible to obtain excellent hot-offset resistivity and satisfy both of excellent blocking resistivity and low-temperature fixability to form high quality images.

Also, the amorphous resin preferably contains at least a polyester resin. If the amorphous resin is a polyester resin, decreasing the glass-transition temperature of the toner (TgA) can be easily realized.

It is also possible that a polyester resin of the amorphous resin comprise at least any one of a fumaric acid, a maleic acid, and a succinic acid as a component.

It is also possible that the amorphous resin and the crystalline resin contain at least a polyester resin and both of a polyester resin of a crystalline resin and a polyester resin of an amorphous resin can comprise at least any one of a fumaric acid, a maleic acid, and a succinic acid as a component.

Since the polyester resin of the amorphous resin comprises any one of a fumaric acid, a maleic acid, and a succinic acid, these components are common to the components of the polyester resin of the crystalline resin and help the attainment of partial compatibilities, and decreasing the glass-transition temperature of the toner (TgA) can be easily achieved.

Also, the content of insoluble tetrahydrofuran (THF) of the polyester resin of amorphous resin being within the range of 0% by mass to 5% by mass is preferable from the perspective of realization of fixing a toner at lower-temperature and ensuring offset resistivity.

On the other hand, it is also preferable in the case of a full color toner that an aromatic dicarboxylic acid is contained to the polyester resin of the amorphous resin as a component, and the content of the insoluble portion of tetrahydrofuran (THF) of the polyester resin is 0% by mass to 5% by mass.

Further, it is also preferred that the amorphous resin and the crystalline resin respectively comprise at least a polyester resin, and the content of tetrahydrofuran (THF) insoluble portion in the polyester resin of the amorphous resin is 0% by mass to 5% by mass, and at least any one of the polyester resin of the crystalline resin and the polyester resin of the amorphous resin contains an aromatic dicarboxylic acid as a component. In a toner in which images can be obtained by overlapping a plurality of colors, like a full color toner, clear images are easily available, and low-temperature fixability can be balanced with hot-offset resistivity, and it becomes easy to ensure the blocking resistivity, even with such a full color toner.

The toner according to the present invention may further comprise a releasant, and the melting point of the releasant is preferably 70° C. to 90° C. If the melting point of the releasant is in the given range, the releasant can sufficiently exert its function.

Also, the volume-averaged particle size of the toner is preferably 2.5μm to 7μm. When the volume-averaged particle size of the toner is in the given range above, high-quality images with excellence in thin-line reproductivity can be formed.

It is also preferred that the toner contains at least any one of inorganic fine particles and resin fine particles. When the toner containes at least any one of inorganic fine particles and resin fine particles, the transferring properties and the durability are enhanced to enable high-quality image formations.

A second aspect of the present invention is a developer which is characterized in that the developer contains the toner of the present invention. When formation of an image is performed by an electrophotography using the developer, a highly sharp and high quality image in high image density can be obtained under low-temperature fixing conditions without any hot offset occurrences, as the developer contains the toner according to the present invention.

A third aspect of the present invention is a toner container in which the toner according to the present invention is housed. Since the toner container is housing the toner of the present invention, when formation of an image is performed by an electrophotography using the toner housed in the toner container, a highly sharp and high quality image in high image density can be obtained under low-temperature fixing conditions without any hot offset occurrences, as the toner of the present invention is housed therein.

A fourth aspect of the present invention is a process cartridge which comprises a electrostatic latent image carrier, and a developing unit configured to develop a electrostatic latent image formed on the electrostatic latent image carrier by using the toner of the present invention to form a visible image. The process cartridge is configured to be attached in a attachable and detachable manner and excels in convenience and allows obtaining a highly sharp and high quality image in high image density under low-temperature fixing conditions without any hot offset occurrences, because the toner of the present invention is used with it.

A fifth aspect of the present invention is a fixing process characterized in that a fixing step configured to fix a transferred image which a visible image is formed using the toner of the present invention is transferred onto a recording medium, on the recording medium. In the fixing process, the transferred image that the visible image formed using the toner of the present invention is transferred onto the recoding medium is fixed on the recording medium. As a result, a highly sharp and high quality image in high image density can be obtained under low-temperature fixing conditions without any hot offset occurrences.

The fixing process according to the present invention is effective even in the case where a recording paper having a smoothness level of 20 sec to 35 sec is used in the recording medium. Using the toner of the present invention enables obtaining a highly sharp and high quality image in a high image density under low-temperature fixing conditions without any hot offset occurrences even in a low-smoothness level recording paper, which the adhesiveness easily tends to lower.

Also, it is preferred as a fixing process to fix a transferred image using a fixing apparatus comprising a pair of fixing rollers which are rotatably brought into pressure contact with one another, a bearing stress of the contact surface between the pair of fixing rollers (roller load/contact dimension) being $1\times10^5$Pa or less, the fixing roller in contact with the transferred image having an inelastic member, the thickness thereof being 1.0 mm or less. According to this process, the fixing step is performed by using a fixing apparatus having a low-bearing stress and low-thermal capacity fixing roller. Thus, the transferred image can be effectively fixed on the recording medium with a little loss of heat quantity.

It is also preferable as a fixing step to use a fixing apparatus which consists a magnetic field generating unit; and a heat-pressure unit which comprises a rotation heat member, and a rotation pressure member, wherein the rotation heat member comprises a heat generation layer for heating through electromagnetic induction, an elastic material layer, and a demolding layer, wherein the rotation pressure member is configured to form a nip portion with the rotation heat member, to fix a transferred image made from a toner on a recording medium by pressing and heating it while the rotation pressure member pressing the transferred image through the recording medium in the nip portion, wherein the amorphous resin of the toner comprises a polyester resin, the polyester resin of the amorphous resin comprises an aromatic dicarboxylic acid as a component; and the amount of insoluble tetrahydrofuran (THF) of the polyester resin is 0% by mass to 5% bay mass.

It is also preferable as a fixing step to use a fixing apparatus which comprises a heat roller made from a magnetic metal for heating through electromagnetic induction; a fixing roller disposed in parallel with the heat roller; an endless belt-like toner heating medium spanned over the heat roller and the fixing roller to be heated by the heat roller as well as to be rotated by these rollers; a pressure roller pressed into contact with the fixing roller through the heating medium and rotates in the forward direction relative to the toner heating medium to form a fixing nip portion, to fix a transferred image made from a toner on a recording medium by pressing and heating it while the pressure roller pressing the transferred image in the fixing nip portion through the recording medium, wherein the amorphous resin of the toner comprises a polyester resin; the polyester resin of the amorphous resin comprises an aromatic dicarboxylic acid as a component; and the amount of insoluble tetrahydrofuran (THF) of the polyester resin is 0% by mass to 5% by mass.

A sixth aspect of the present invention is an image forming apparatus which comprises a electrostatic latent image carrier, a electrostatic latent image forming unit configured to form an electrostatic image on the electrostatic latent image carrier, a developing unit configured to develop the electrostatic image by means of the toner according to the present invention to form a visible image, a transferring unit configured to transfer the visible image on a recording medium, and an image fixer configured to fix the transferred image on the recording medium.

In the image forming apparatus, the electrostatic latent image forming unit forms a electrostatic latent image on the electrostatic latent image carrier; the developing unit develops the electrostatic latent image by using the toner according to the present invention to form a visible image; the transferring unit transfers the visible image on a recording medium; and the fixing unit fixes the transferred image on the recording medium. As a result, a highly sharp and high quality image in a high image density can be obtained under low-temperature fixing conditions without any hot offset occurrences.

A seventh aspect of the present invention is an image forming process which comprises a electrostatic latent image forming step for forming a electrostatic latent image on a electrostatic latent image carrier; a developing step for developing the electrostatic latent image by means of the toner according to the present invention to form a visible image; a transferring step for transferring the visible image on a recording medium; a fixing step for fixing the transferred image on the recording medium.

In the image forming process, a electrostatic latent image is formed on a electrostatic latent image carrier in the electrostatic latent image forming process; the electrostatic latent image is developed by using the toner according to the present invention to formed a visible image in the developing step; the visible image is transferred on a recording medium in the transferred step; and the transferred image is fixed on the recording medium in the fixing step. As a result, a highly sharp and high quality image in a high image density can be obtained under low-temperature fixing conditions without any hot offset occurrences.

According to the present invention, a toner that can solve various problems in the conventional related art and excels in charge properties, transferring properties, and fixability, has excellent hot offset resistivity, is capable of balancing excellent blocking resistivity and low-temperature fixability to enables forming high quality images can be provided. Moreover, a developer using the toner and enabling higher quality images, a toner container, a process cartridge, a fixing process, an image forming apparatus, and an image forming process can be also provided.

DESCRIPTION OF THE PREFERRED EMBODIMENTS (Toner)

Figure 1:
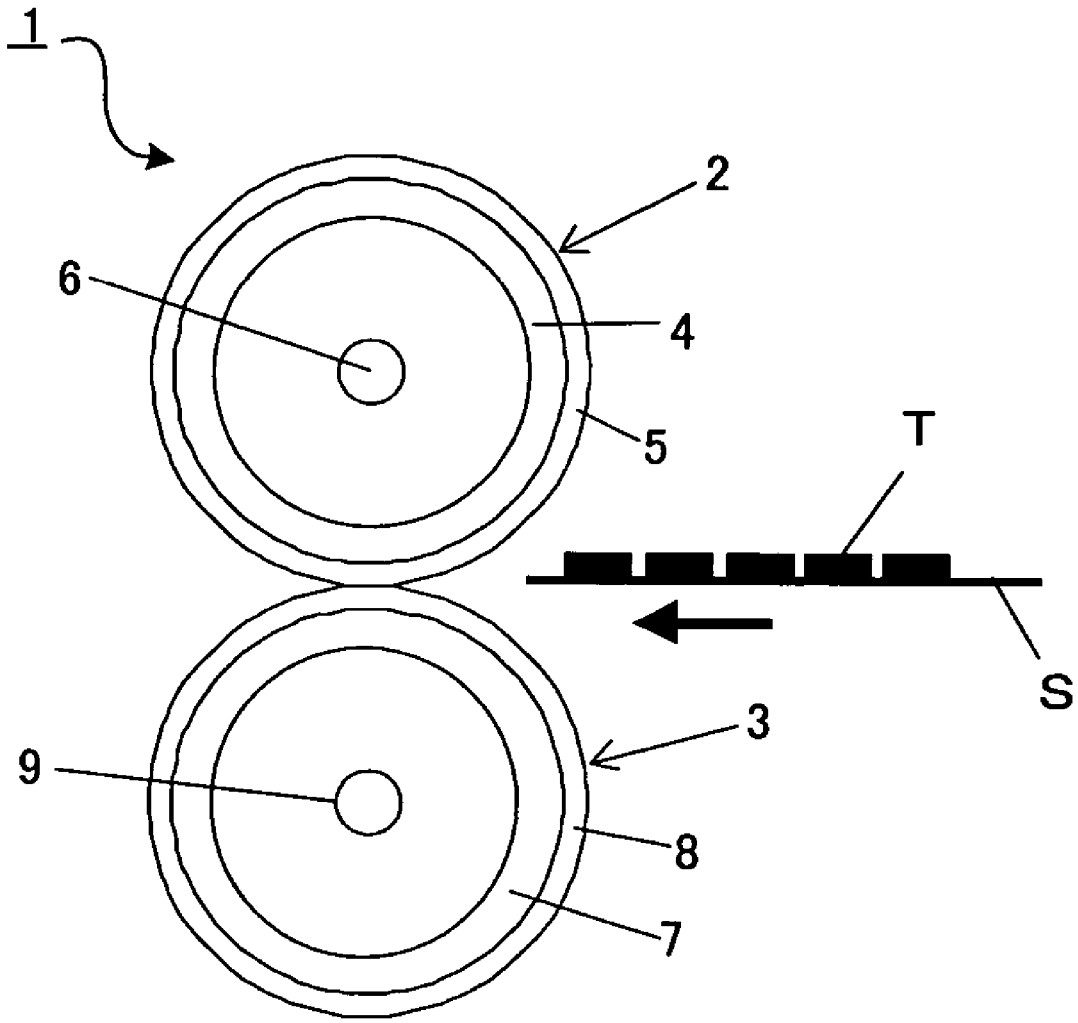
FIG. 1 is a schematic view showing an example of performing the fixing process according to the present invention.

The toner according to the present invention comprises an amorphous resin and a crystalline resin as a binder resin, in which at least a part of the amorphous resin and a part of the crystalline resin are compatible each other, further comprises other components such as a colorant, a releasant, inorganic fine particles, resin fine particles, and a charge controller, as required.

The glass-transition temperature of the toner (TgA) should be lower than the glass-transition temperature (TgC) expressed by the following equation (1), and the glass-transition temperature (TgA) is preferably 10° C. or more lower than the (TgC). If the difference between the glass-transition temperature of the toner (TgA) and the calculated TgC value becomes greater, the contribution to low-temperature fixability based on the combination an amorphous resin and a crystalline resin also becomes greater. However, the glass-transition temperature of the toner (TgA) is preferably 35° C. or more, because if the temperature becomes too low, the blocking resistivity is liable to become insufficient.

$$TgC = \sum_{i=1}^{n} b_i \Big/ \sum_{i=1}^{n} \left( \frac{b_i}{TgB_i} \right) \qquad \text{Equation (1)}$$

In the above equation (1), "TgBi" represents the glass-transition temperature of the amorphous resin, "n" represents the number of amorphous resins, and "b" represents the content of the amorphous resin (part by mass).

With respect to the glass-transition temperature of the amorphous resin in the toner, if there is only a single amorphous resin (n=1), the above-stated equation (1) represents the glass-transition temperature of the resin, and if there are two or more amorphous resins (n≧2), the formula represents the harmonic average temperature of the respective glass-transition temperature of these resins after compatibilization of these resins in the case where these resins are compatible.

The glass-transition temperature of the toner (TgA) according to the present invention is required to not only be lower than the harmonic average glass-transition temperature of the resins constituting the toner but also be lower than the harmonic average (TgC) of the glass-transition temperature of just only the amorphous resin (TgB) constituting the toner.

To obtain the glass-transition temperature (TgA), the toner temperature is increased at a temperature rising rate of 10° C./min from 20 to 150° C. by using, for example, a differential scanning calorimeter (such as "DSC-60"; manufactured by SHIMADZU Corp.), and then without retention time cooled down to the measurement starting temperature at a temperature decreasing rate of 10° C./min, followed by measurement at an temperature rising rate of 10° C./min. Then, the glass-transition temperature of the toner (TgA) is obtained by means of the tangent line method at the time when the toner temperature increased for the first time after being subjected to all the above steps.

Crystalline Resin

The crystalline resin has a melting point and sharp melt properties that cause a crystal transformation in the melting point and the melting viscosity has drastically lowered from the solid condition.

It is preferable that the crystalline resin is partially compatible with the amorphous resin. At least a part of the crystalline resin and a part of the amorphous resin being compatible each other enables decreasing the glass-transition temperature of the toner (TgA) to decrease the temperature that the melting viscosity of the toner is starting to decrease. Also, the crystalline resin having a melting point higher than that of the amorphous resin can be dispersed to ensure the blocking resistivity even if the glass-transition temperature of the toner (TgA) is low.

The compatibility between the amorphous resin and the crystalline resin can be measured, for instance, by the following process.

Namely, the temperature of the mixture of the amorphous resin and the crystalline resin (mass ratio: 1:1) is increased from 20° C. to 150° C. at a temperature rising rate of 10° C./min. by using, for example, a differential scanning calorimeter (such as "DSC-60"; manufactured by SHIMADZU Corp.) and then cooled down to the measurement starting temperature at a temperature decreasing rate of 10° C./min with no retention time, followed by measurement at a temperature rising rate of 10° C./min. Then, the glass-transition temperature of the toner is obtained by means of the tangent line method at the time when the toner temperature increased for the second time after being subjected to all the above steps. If the obtained the glass-transition temperature (Tg) obtained by the tangent line method is 2° C. or more lower than the glass-transition temperature (TgB) of the amorphous resin and if any endotherm of the crystalline resin origin is observed, it can be judged that the amorphous resin and the crystalline resin are partially compatible each other. Also, when the endotherm of the crystalline resin origin overlaps the endotherm of the amorphous resin, and if the peak endotherm amount is larger than the endotherm amount of the amorphous resin presumed based on the mixture ratio, it can be judged that there is endotherm of the crystalline resin origin.

It is noted that fixing a toner at lower-temperature through making the crystalline resin contained is enabled by just making the crystalline resin and the amorphous resin partially compatible, but more excellent low-temperature fixability can be ensured by using both the glass-transition temperature of the toner (TgA) and the glass-transition temperatures (TgB) of the amorphous resin constituting the toner to make the respective temperatures lower than the value calculated by the above equation (1) (TgC).

Ensuring the blocking resistivity through dispersion of a crystalline resin is facilitated by making a crystalline polyester contained in the toner so that the endothermic peak of the crystalline resin origin can reside on the endothermic curve of DSC (differential scanning calorimetry) of the toner.

There is no particular limitation on the crystalline resin, and it can be selected in accordance with the intended use, but it is preferably an aliphatic polyester resin synthesized by using an alcohol component containing a diol compound having the carbon number of 2 to 20 and the derivatives thereof, and an acid component containing a polyvalent carboxylic acid compound such as an aliphatic dicarboxylic acid, an aromatic dicarboxylic acid, alicyclic dicarboxylic acid and the derivatives thereof.

There is no particular limitation on the aliphatic polyester resin, and it can be selected in accordance with the intended use, but it is preferably a polyester resin containing the constitutional unit expressed by the following formula (1) in that a toner having high sharp melt properties can be formed.

$$[—OOC—R—COO—(CH_2)_n—] \quad \text{Formula (1)}$$

In the above formula, "R" represents a divalent hydrocarbon group having the number of carbons of 2 to 20, and preferably a divalent hydrocarbon group of aliphatic series having the number of carbons of 2 to 20, and more preferably the number of carbons of 2 to 6. "n" is preferably integral number of 2 to 20, and more preferably an integral number of 2 to 20. The divalent hydrocarbon group is not particularly limited provided that the crystallinity is not impaired. The divalent hydrocarbon group comprises an aliphatic divalent hydrocarbon group and an aromatic divalent hydrocarbon group, and a preferred divalent hydrocarbon group is an aliphatic divalent hydrocarbon group. The aliphatic divalent hydrocarbon group includes straight chain styled one and branched chain styled one, and a divalent hydrocarbon group of straight chain aliphatic series is preferable. In the case of the present invention, it is particularly preferable that "R" is a divalent hydrocarbon group of straight chain unsaturated aliphatic series. Examples of the divalent hydrocarbon group include ethylene group, n-propylene group, vinylene group, propenylene group, isopropenylene group, n-butylene group, phenylene group, cyclohexylene group.

The polyester resin can be produced by subjecting (i) a polyvalent carboxylic acid component made from a divalent carboxylic acid or the reactive derivatives thereof (such as an acid anhydride, a low-class alkyl ester having the number of carbons of 1 to 4, and an acid halide) and (ii) a polyvalent alcohol component made from a diol, to a polycondensation reaction by means of a conventional method. It is possible to add a trivalent or quadrivalent carboxylic acid to the polyvalent carboxylic acid component. It is also possible to a trivalent or quadrivalent alcohol to the polyvalent diol component.

Examples of the divalent carboxylic acid include a maleic acid, a fumaric acid, a 1,3-n-propen-dicarboxylic acid, a 1,4-n-butene-dicarboxylic acid, a succinic acid, a glutaric acid, an adipic acid, a suberin acid, a sebacic acid, a cyclohexane dicarboxylic acid, a terephthalic acid. Examples of the diol include an ethylene glycol, a 1,3-propylene glycol, a 1,4-butanediol, and a 1,6-hexanediol. The loadings of the trivalent or quadrivalent carboxylic acid to the total amount of carboxylic acid in accordance with the intended use is usually 40 mole % or less, preferably 20 mole % or less, and more preferably 10 mole % or less. A trivalent or quadrivalent carboxylic acid is added to the carboxylic acid within the range where the obtained polyester resin can have crystallinity.

Examples of the trivalent or quadrivalent carboxylic acid that can be added as required to the polyvalent carboxylic acid include a polyvalent carboxylic acid such as an anhydrous trimellitic acid, a 1,2,4-benzenetricarboxylic acid, a 1,2,5-benzenetricarboxylic acid, a 1,2,4-cyclohexane tricarboxylic acid, a 1,2,4-naphthalene tricarboxylic acid, a 1,2,5-hexyane tricarboxylic acid, a 1,3-dicarboxyle-2-methylene carboxypropane, and a 1,2,7,8-octane-tetracarboxylic acid.

It is possible to add a polyvalent alcohol having trivalent or more alcohol to the polyvalent alcohol component as required besides a small amount of branched chain aliphatic divalent alcohol and a cyclic divalent alcohol. The loadings of the above-noted polyvalent alcohol to the total amount of alcohol component is 40 mole % or less, preferably 20 mole % or less, and more preferably 10 mole % or less. The above-noted polyvalent alcohol is added to the polyvalent alcohol component within the range where the obtained polyester resin can have crystallinity. Examples of the polyvalent alcohol that can be added to the polyvalent alcohol component as required include 1,4-bis (hydroxymethyl) cyclohexane, a polyethylene glycol, a bisphenol-A-ethylene oxide adduct, a bisphenol-A-propylene oxide adduct, and glycerin.

In addition, as to the polyester resin, an aspect that the polyester resin includes an aromatic dicarboxylic acid as an acid component is preferred from the perspective of preventing the resin from becoming too compatible to hold crystalline portions, when there is no content of tetrahydrofuran (THF) insoluble portion in the amorphous resin or when there is a small amount of THF in the amorphous resin.

Also, to synthesize a nonlinear polyester resin, a trivalent or more polyvalent alcohol such as glycerin may be added to the alcohol component, or a trivalent or more polyvalent carboxylic acid such as an anhydrous trimellitic acid may be added to the acid component to perform a condensation polymerization.

With respect to the melting point of the crystalline resin, if the resin has high sharp melt properties, it significantly impacts on the lower limit temperature of fixing. The melting point is preferably a low point provided that blocking or the like does not occur. Specifically, the melting point is preferably 80° C. to 130° C., and more preferably 80° C. to 120° C. If the melting point is less than 80° C., it may become difficult to synthesize a crystalline resin having sharp melt properties and excellent low-temperature fixability, and if the melting point is more than 130° C., preferable low-temperature fixability may not be obtained because the lower limit fixing temperature becomes higher.

To obtain the melting point of the crystalline resin, the temperature of the toner is increased at a temperature rising rate of 10° C./min from 20° C. to 150° C. by using, for example, a differential scanning calorimeter (such as "DSC-60"; manufactured by SHIMADZU Corp.), and then without retention time cooled down to the measurement starting temperature at a temperature decreasing rate of 10° C./min, followed by measurement at a temperature rising rate of 10° C./min. Here, the melting point of the crystalline resin can be obtained by calculating the endotherm peak temperature at the time when the toner temperature increased for the second time after being subjected to all the above steps.

The presence of crystallinity in the crystalline resin can be identified by the diffraction pattern using a powder x-ray diffractometer. The diffraction pattern of the crystalline resin comprises a diffraction peak at least at $2\theta=20°$ to 25°, and it is preferable that the diffraction pattern comprises a diffraction peak at any of $2\theta=19°$ to 20°, $2\theta=21°$ to 22°, $2\theta=23°$ to 25° and $2\theta=29°$ to 31°. The diffraction pattern can be checked by using, for instance, an x-ray diffractometer ("RINT-1100"; manufactured by Rigaku Corp.) through the use of a standard sample holder for XRD under the following conditions to measure the fine particle. Namely, under the conditions of x-ray tube: Cu; x-ray tube voltage: 50KV-30 mA; goniometer: a wide angle goniometer; sampling width: 0.020°; scanning rate: 2.020 /min.; scanning range: 5° to 50°, the presence or absence of the diffraction peak can be judged from a detected peak by searching the diffraction peak that is counted as the smoothness score as 11.

The crystalline resin content of the binder resin is preferably 50% by mass or less, and more preferably 5 to 50% by mass. If the content is more than 50% by mass, the dispersibility of these resins in the toner may worsen because the crystalline resin is not compatible with the amorphous resin and is liable to take a phase-separated structure. Besides, the charge properties of the toner becomes worse due to unevenness of a colorant and a wax in the toner, an image blushing may occur, and smears caused by toner scattering may arise in a copier. If the crystalline resin content is less than 5% by mass, there may be cases where the low-temperature fixability becomes degraded.

Amorphous Resin

The amorphous resin has a property that the melting viscosity is gradually decreasing from the above-noted glass-transition temperature (TgB) in accordance with increasing in temperature.

There is no particular limitation on the amorphous resin, and it can be selected from among resins known in the art in accordance with the intended use. Examples of the amorphous resin include a styrene resin, such as, a styrene, an α-methyl styrene, a chlorostyrene, a styrene-propylene copolymer, a styrene-butadiene copolymer, a styrene-vinyl chloride copolymer, a styrene-vinyl acetate copolymer, a styrene-maleate copolymer, a styrene-ester acrylate copolymer, a styrene-ester methacrylate copolymer, a styrene-acrylonitrile-acrylic ester copolymer; and a polyester resin, a vinyl chloride resin, a rosin-denaturalized maleate resin, a phenol resin, a epoxy resin, a polyethylene resin, a polypropylene an ionomer resin, a polyurethane resin, a silicone resin, a ketone resin, a xylene resin, a petroleum resin, and a hydrogen-added petroleum resin. Among these materials, it is preferably a styrene resin and a polyester resin containing an aromatic compound as a component, and a polyester resin is particularly preferable.

The polyester resin is synthesized from a polyvalent alcohol and a polyvalent carboxylic acid. There is no particular limitation on the polyvalent alcohol and the polyvalent carboxylic acid, and both can be selected in accordance with the intended use. For example, the component used for the above-mentioned crystalline polyester resin is suitably usable. Besides, an alkylene oxide adduct of bisphenol-A, an isophthalic acid, a terephthalic acid, and the derivatives thereof can be used. Each of these resins may be employed alone or in combination of two or more. Particularly, it is preferable that the acid component contains at least any one of a maleic acid, a fumaric acid, a succinic acid, and the derivatives thereof. Particularly when a crystalline polyester containing the constitutional unit expressed by the above-noted formula (1) in which any one of a maleic acid, a fumaric acid, and a succinic acid is included as the acid components of the crystalline resin, the components are same as that of the above noted, therefore, the crystalline polyester enable the glass-transition temperature of the toner (TgA) to further decrease.

The glass-transition temperature of the amorphous resin (TgB) is preferably 40° C. to 70° C. If the glass-transition temperature (TgB) is less than 40° C., the heat-resistance storage stability of the toner may considerably become worsen, and blocking may occur. If TgB is more than 70° C., the low-temperature fixability of the toner may become degraded.

To obtain the glass-transition temperature of the amorphous resin (TgB), the toner temperature is increased at a temperature rising rate of 10° C./min from 20° C. to 150° C. by using, for example, a differential scanning calorimeter (such as "DSC-60"; manufactured by SHIMADZU Corp.), and then without retention time cooled down to the measurement starting temperature at a temperature decreasing rate of 10° C./min, followed by measurement at a temperature rising rate of 10° C./min. Here, the glass-transition temperature of the amorphous resin (TgA) can be obtained by means of the tangent line method at the time when the toner temperature increased for the second time after being subjected to all the above steps The softening point temperature of the amorphous resin (F1/2) is preferably 120° C. to 160° C. If the temperature of the softening point (F1/2) is less than 120° C., the hot offset properties may become worsen, and if more than 160° C., it tends to have high elasticity, and the share of time for dispersing the material constituting the toner will become higher, and the load of a kneader will become large. Besides, the low-temperature fixability may become worsen.

The softening point temperature of the amorphous resin (F1/2) can be obtained from the flow curve measured by using an elevated flow tester, CFT500 model (manufactured by SHIMADZU Corp.). The temperature of F1/2 is the temperature that the stroke at the time when a sample of 1 $cm^3$ being melted and discharged under the conditions of a dies hole diameter of 1 mm and a dies hole length of 1 mm, at a pressure of 10 $kgf/cm^2$, and a temperature rising rate of 3° C./min. has become half of the amount of the stroke change from the fluxion starting point to the fluxion end point.

The content of insoluble tetrahydrofuran (THF) in the amorphous resin is preferably 10% by mass or more, and more preferably 10% by mass to 40% by mass. If the insoluble tetrahydrofuran content is in the above-noted range, it makes balancing the offset resistance with the low-temperature fixability easier. If the toner is a full-color toner, the insoluble tetrahydrofuran (THF) content in the amorphous resin is preferably 0% by mass to 5% by mass, because a plurality of colors are sufficiently melted for coloration. If there is no or a little insoluble tetrahydrofuran (THF) included in the amorphous resin, even if the composition of a crystalline resin differs from that of the amorphous resin, these resins become easily compatible, and the toner is easily made to have a low glass-transition temperature. On the other hand, if these resins have too much identical components, there may be cases where the crystalline portion cannot be maintained due to the exceeding compatibility therebetween. Thus, in the case of a polyester resin having a little amount of insoluble tetrahydrofuran in the amorphous resin, it is preferable that the acid component contains an aromatic dicarboxylic acid and the derivatives thereof. Such a combination of components enables ensuring hot-offset resistivity and blocking resistivity when fixing a toner at low-temperature and obtaining a color-brilliant full-color toner.

The insoluble amount of tetrahydrofuran (THF) in the amorphous resin is calculated by extracting the soluble amount of tetrahydrofuran by means of a Soxhlet extractor. The extraction of the amount of soluble tetrahydrofuran (THF) by means of a Soxhlet extractor was carried out as follows: 5 g of a resin is precisely weighed and put in a cylindrical chromatography having an internal diameter of 24 mmΦ and set in the extraction tube, and 100g of tetrahydrofuran (THF) is put in a flask. A set of the flask with a cooling tube fitted thereon is put in a mantle heater to reflux the tetrahydrofuran (THF) at 80° C. so that the tetrahydrofuran (THF) from the cooling tube can be delivered by drops into the resin to make the soluble amount of the tetrahydrofuran (THF) extracted in the flask. After a 10-hour extraction, the extract of tetrahydrofuran (THF) is depressurized and removed to obtain the residue amount. The amount of insoluble tetrahydrofuran (THF) is calculated on the basis of the precise weighing value (A) of 5 g of the resin and the residual weight of the extract (B), as $(1-B/A)\times 100$.

It is noted that if the amorphous resin is made from just only the amorphous resin and the glass-transition temperature of the amorphous resin is lowered so that decreases in the melting viscosity is starting at low temperature, as well as the molecular weight and the gel portion are lessened so that the melting viscosity can drastically decrease, this enables the low-temperature fixability, but hot-offset resistivity and blocking resistivity are liable to be insufficient. However, the toner according to the present invention can achieve a drastic decrease in the melting viscosity without suffering such problems by making the above-noted crystalline resin contained in the amorphous resin.

Other Components

There is no particular limitation on the other components, and they can be selected in accordance with the intended use. Examples of the other components include a colorant, a releasant, inorganic fine particles, a resin fine particles, a charge controller, a flow improver, a cleaningability improver, and a magnetic material.

There is also no particular limitation on the colorant, and it can be selected from among conventional dyes and pigments known in the art in accordance with the intended use. Examples of the colorant include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzene yellow (G, GR), permanent yellow (NCG), vulcan fast yellow (5G, R), tartrazinelake yellow, quinoline yellow lake, anthraene yellow BGL, isoindolinon yellow, colcothar, red lead, cadmium red, cadmium mercury red, antimony red, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine ornage, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, and lithopone.

These dyes and pigments may be employed alone or in combination of two or more.

The colorant content of the toner is not particularly limited and may be selected in accordance with the intended use, and preferably 1% by mass to 15% by mass, and more preferably 3% by mass to 10% by mass.

If the above-noted content is less than 1% by mass, degradation of the tinting power of the toner is possibly seen, and if more than 15% by mass, unfavorable dispersion of pigments possibly occurs in the toner, and this may cause degradations of the tinting power and the electric properties of the toner.

The above-noted colorant may be used as a master batch compounded with a resin. The resin is not particularly limited and may be selected from among conventional resins known in the art in accordance with the intended use. Examples of the resins include a styrene or a derivative substitution polymer thereof, a styrene copolymer, a styrene copolymer, a polymethyl methacrylate, a polybutyl methacrylate, a polyvinylchloride, a polyvinyl acetate, a polyethylene, a polypropylene, a polyester, an epoxy resin, an epoxy polyol resin, a polyurethane, a polyamide, a polyvinyl butyral, a polyacrylic acid resin, a rodin, a denaturalized-rodin, a terpene resin, an aliphatic hydrocarbon resin, an alicyclic hydrocarbon resin, an aromatic petroleum resin, a chlorinated paraffin, and a paraffin wax. Each of these colorants may be employed alone or in combination of two or more.

Examples of the styrene and the derivative substitution polymer thereof include a polyester resin, a polystyrene, poly-p-chlorostyrene, and a polyvinyl toluene. Examples of the styrene copolymer include a styrene-p-chlorostyrene copolymer, a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, styrene-a-methyl chlormethacrylate copolymer, a styrene-acrylonitrile copolymer, a styrene-vinylmethyl ketone copolymer, a styrene-butadiene copolymer, a styrene-isoprene copolymer, a styrene-acrylonitrile-indene copolymer, a styrene-maleate copolymer, and a styrene-ester maleate copolymer.

The above-noted master batch can be manufactured by mixing or kneading the above noted resin for master batch and the above-noted colorant under a high shearing force. Here, to improve the interaction between the colorant and the resin, it is preferable to add an organic solvent. Besides, so-called flashing process is suitable in that a wet cake of a colorant can be directly used without the necessity of drying. A flashing process is a process for mixing or kneading a colorant's water paste containing water with a resin and an organic solvent to transfer the colorant to the resin and remove the moisture and the organic solvent component. For mixing or kneading as above, for example, a high shearing dispersion device such as a triple roll mill is preferably used.

There is no particular limitation on the above-noted releasant, and it can be selected from among releasants known in the art in accordance with the intended use. A wax and the like are suitably used as the releasant.

Examples of the wax include a low-molecular-weight polyolefin wax, a synthetic hydrocarbon wax, a permanent wax, a petroleum wax, a higher fatty acid and the metal salt thereof, a higher fatty acid amide, and various denaturalized waxes thereof. These waxes may be employed alone on in combination of two or more.

Examples of the low-molecular-weight polyolefin wax include a low-molecular-weight polyethylene wax, and a low-molecular-weight polypropylene.

Examples of the synthetic hydrocarbon wax include a Fischer-Tropsch wax.

Examples of the permanent wax include a beeswax, a carnauba wax, candelilla wax, a rice wax, and a montan wax.

Examples of the petroleum wax include a paraffin wax, and micro crystalline wax.

Examples of the higher fatty acid include a stearin acid, a palmitic acid, and a myristic acid.

There is no particular limitation on the melting point of the above-noted releasant, and it can be selected in accordance with the intended use, and it is preferably 65° C. to 110° C., and more preferably 70° C. to 90° C.

If the melting point of the releasant is less than 65° C., the releasant may have negative impacts on the blocking resistivity, and if more than 110° C., it is liable to cause a cold offset when fixing at low temperature, and paper twining around fixing machine may occur.

There is no particular limitation on the releasant content of the toner, and it can be selected in accordance with the intended use, but it is preferably 1 part by mass to 20 parts by mass, and more preferably 3 parts by mass to 10 parts by mass. If the releasant content of the toner is more than 20 parts by mass, deterioration of toner fluidity may be seen, and problems with smears of other members may be seen.

There is no particular limitation on the above-noted inorganic fine particles, and it can be selected from among inorganic fine particles known in the art in accordance with the intended use. Examples of the inorganic fine particles include a silica, an alumina, a titanium oxide, a barium titanate, a magnesium titanate, a calcium titanate, a strontium titanate, a zinc oxide, a tin oxide, a silica sand, a clay, mica, a wollastonite, a silious earth, a chrome oxide, a ceric oxide, a colcothar, an antimony trioxide, a magnesium oxide, a zirconium oxide, a barium sulfate, a barium carbonate, a calcium carbonate, a silicon carbide, and a silicon nitride. These inorganic fine particles may be employed alone or in combination of two or more.

A first-order particle diameter of the inorganic fine particle is preferable 5 nm to 2μm, and more preferably 5 nm to 500 nm. In addition, the surface to volume ratio of the inorganic fine particle by means of BET equation is preferably $20m^2/g$ to $500m^2/g$.

The inorganic fine particle content of the toner is preferably 0.01% by mass to 5.0% by mass, and more preferably 0.01% by mass to 2.0% by mass. It is noted that the inorganic fine particle can be suitably used as an outer additive of the toner.

There is no particular limitation on the above-noted resin fine particle, and it can be selected from among resins known in the art in accordance with the intended use, and a thermoplastic resin may be used, and a thermosetting resin may be used. Examples of the resin include a vinyl resin, a polyurethane resin, an epoxy resin, a polyester resin, a polyamide resin, a polyimide resin, a silicon resin, phenol resin, a melamine resin, a urea resin, an aniline resin, an ionomer resin, and a polycarbonate resin.

These resins may be employed alone or in combination of two or more. Among these resins, it is preferred that the resin comprises one resin selected from vinyl resin, polyurethane resin, epoxy resin, and polyester resin in that fine and spherical aqueous dispersions of resin particles are easily obtained.

The above-noted vinyl resin is a polymer that the vinyl monomer is homopolymerized or copolymerized. Examples of the vinyl resin include styrene-(meta) ester acrylate resin, a styrene-butadiene copolymer, a (meta) ester acrylate copolymer, a styrene-acrylonitrile copolymer, a styrene-maleic anhydride copolymer, and a styrene-(meta) acrylic acid copolymer.

Also, for the above-noted resin fine particle, a copolymer made from a monomer having at least two unsaturated moieties can be used.

There is no particular limitation on the monomer having at least two unsaturated moieties, and it can be selected in accordance with the intended use. Examples of the monomer include a sodium salt of ethylene oxide methacrylate adduct sulfuric ester ("ELEMINOL RS-30"; manufactured by Sanyo Chemical Industries, Ltd.), a diivnylbenzene, and a 1; 6-hexanediol acrylate.

The volume-averaged particle diameter of the above-noted resin fine particle is preferably 20 nm to 400 nm, and more preferably 30 nm to 350 nm. If the volume-averaged particle diameter is less than 20 nm, the resin fine particle residues on the surface of the toner may coat the toner surface and may thickly cover the entire toner surface. As a result, this may block the adhesiveness between the toner and the fixing paper as a transferring member, and the lower limit fixing temperature may be increased. If the volume-averaged particle diameter is more than 400 nm, the resin fine particles may obstacle the exudation of the wax components to cause offset occurrences because sufficient toner releasing properties cannot be obtained.

The resin fine particle coverage of the toner is preferably 75% to 100%, and more preferably 80% to 100%. If the coverage is less than 75%, the storage stability of the toner may be degraded to cause a blocking at the time of storing or using the toner.

The content of the resin fine particles to the toner is preferably 0.5% by mass to 8.0% by mass, and more preferably 0.6% by mass to 7.0% by mass. If the content of the resin fine particles content to the toner is less than 0.5% by mass, the storage stability of the toner may be degraded to cause a blocking at the time of storing or using the toner. If more than 8.0% by mass, the resin fine particles may obstacle the exudation of the wax components to cause offset occurrences because sufficient toner releasing properties cannot be obtained.

With respect to the above-noted charge controller, there is no particular limitation on it, it can be selected from among charge controllers known in the art in accordance with the intended use; however, a colorless material or a material close to white color is preferred, because color tones could be sometimes changed when a charge controller made from colored materials is used. Examples of the charge controller include a nigrosin dye, a triphenylmethane dye, a chrome-contained metal complex, a molybdate chelate pigment, a rhodamine dye, an alkoxy amine, a quaternary ammonium salt (containing fluorine-denaturalized quaternary ammonium salt), an alkyl amide, simple. body of phosphorus or the compound thereof, simple body of tungsten or the compound thereof, a fluorine activator, a metal salt of salicylate, and a metal salt of salicylate derivatives. Among these materials, a metal salt from a metal salt of salicylate and a metal salt of salicylate derivatives is preferred. Each of these materials may be employed alone or in combination of two or more. There is no particular limitation on the metal, and it can be selected in accordance with the intended use, and examples of the metal include aluminum, zinc, titanium, strontium, boron, silicon, nickel, iron, chrome, and zirconium.

For the charge controller, commercial products may be used. Examples of the commercial charge controller include "Bontron-P-51" of a quaternary ammonium salt, "E-82" of an oxynaphthoic acid metal complex, "E-84" of a salicylate metal complex, "E-89" of a phenol condensate (aforesaid items are all manufactured by Orient Chemical Industries, Ltd.), "TP-302" of a quaternary ammonium salt molybdenum complex, "TP-415" (aforesaid items are all manufactured by HODOGAYA CHEMICAL CO., Ltd.), "Copy-charge PSY VP2038" of a quaternary ammonium salt, "Copy Blue PR" of a triphenylmethane derivative, "Copy-charge NEG VP2036" of a quaternary ammonium salt, "Copy-charge NX VP434" (aforesaid items are all manufactured by Hoechst Ltd.), "LRA-901", "LR-147" of a boron complex (aforesaid items are all manufactured by Japan Carlit Co., Ltd.), quinacridone, azo dyes, and a macromolecule compound having functional groups such as sulfonic acid group, carboxyl acid group.

The above-noted charge controller may be melted or dispersed after melting and kneading it together with the above-mentioned master batch, or may be added when directly melting and kneading it in the above-noted organic solvent together with various components of the toner, or may be fixed on the toner surface after the toner particles are produced.

The content of the charge controller to the toner varies depending on the type of the above-noted binder resin, presence or absence of additives, and the dispersion process; however, for instance, the charge controller content to 100 parts by mass of the binder resin is preferably 0.1 part by mass to 10 parts by mass, and more preferably 1 part by mass to 5 parts by mass. If the charge controller content is less than 0.1 part by mass, degradation of the charge properties of the toner may be seen, and if more than 10 parts by mass, the charge properties of the toner becomes exceedingly large to diminish the effect of the main charge controller, and this may increase the electrostatic suction force with developing rollers to cause degradation of the developer's fluidity and degradation of the image density.

The above-mentioned fluidity improver means the one capable of preventing the fluidity properties and the charge properties even under high-humidity conditions where the surface finishing has been performed to increase the hydrophobicity.

Examples of the fluidity improver include a silane coupling agent, a sililation reagent, a silane coupling agent having fluoro-alkyl groups, an organic titanate coupling agent, an aluminum coupling agent, a silicone oil, and a denaturalized silicone oil.

The above-noted cleaning ability improver is added to the toner for removing the developer residues remaining on the photoconductor and the primary transfer medium after transferring. Examples of the cleaningability improver include a zinc stearate, a calcium stearate, a fatty acid metal salt such as stearic acid, polymethyl methacrylate fine particles, and a polymer fine particles manufactured by an emulsion polymerization process with soap-free, such as polystyrene fine particles. Polymer fine particles of which the particles size distribution is relatively narrow are preferred, and the ones having the volume-averaged particle diameter of 0.01 μm to 1 μm are suitably used.

With respect to the manufacturing process of the toner according to the present invention, there is no particular limitation on it, and it can be selected from among processes known in the art in accordance with the intended use. Examples of the manufacturing process of the toner include a crushing process for melting and kneading materials constituting the toner and then crushing and classifying the processed materials, and a polymerization.

When the constituent materials are dispersed by melting and kneading, the partial compatibility may be adjusted by the shearing force at the time of the melting and kneading. For instance, in the case of a combination with a resin having a small decrease in the glass-transition temperature on the basis of the partial compatibility, by increasing the revolutions per minute of the kneader, or by making the kneader's setting temperature lower than the resin's F1/2 temperature to knead the materials under the conditions where the materials have been melted by the increased temperature through the toner constituents self-heating, it becomes possible to easily get the shearing force to easily make the toner's glass-transition temperature (Tg) lowered.

With respect to the toner according to the present invention, there is no particular limitation on the physical properties, such as configuration and size, and those can be selected in accordance with the intended use, but it is preferred to have the following heat characteristics, the volume-averaged particle diameter or the like.

The heat characteristics are also called as flow tester properties are, for instance, evaluated as softening temperature (Ts), fluxion beginning temperature (Tfb), softening point based on ½ method (F1/2), and the like.

These heat characteristics can be measured by a process selected as required. For example, heat characteristics can be obtained from the flow curve measured by means of an elevated flow tester of Model CFT500 (manufactured by SHIMADZU Corp.).

The softening temperature (Ts) is not particularly limited and may be selected in accordance with the intended use. For example, it is preferably 30° C. or more, and more preferably 50° C. to 120° C. If the softening temperature (Ts) is less than 30° C., there may be cases where at least any one of durability and low-temperature storage stability may be degraded.

As to the fluxion beginning temperature (Tfb), there is no particular limitation on it can be selected as required. For example, it is preferably 50° C. or more, and more preferably 60° C. to 150° C. If the fluxion beginning temperature (Tfb) is less than 50° C., there may be cases where at least any one of hot-offset resistivity and low-temperature storage stability may be degraded.

As to the softening point based on ½ process (F1/2), there is no particular limitation on it, and it can be selected as required. For example, it is preferably 60° C. or more, and more preferably 80° C. to 170° C. If the softening point based on ½ process (F1/2) is less than 60° C., there may be cases where at least any one of hot-offset resistivity and low-temperature storage stability may be degraded.

It should be noted that the softening point based on the ½ process (F1/2) is the temperature that the stroke at the time when a sample of 1 $cm^3$ being melted and discharged under the conditions of a dies hole diameter of 1 mm and a dies hole length of 1 mm, at a pressure of 10 $kgf/cm^2$, and a temperature rising rate of 3° C./min. has become half of the amount of the stroke change from the fluxion starting point to the fluxion end point, when using an elevated flow tester, CFT500 model (manufactured by SHIMADZU Corp.).

The temperature of F1/2 is the temperature that the stroke at the time when a sample of 1 $cm^3$ being melted and discharged under the conditions of a dies hole diameter of 1 mm and a dies hole length of 1 mm, at a pressure of 10 $kgf/cm^2$, and a temperature rising rate of 3° C./min. has become half of the amount of the stroke change from the fluxion starting point to the fluxion end point.

The volume-averaged particle diameter of the toner is preferably, for instance, 2.5 μm to 10 μm, and more preferably 2.5 μm to 7 μm.

If the volume-averaged particle diameter is less than 2.5 μm, in the case of a developer containing two components, the toner may be fused onto the carrier's surface over a long period of agitation in the image-developer to reduce the charge capability of the carrier, and in the case of a developer containing a single component, toner-filming onto the developing rollers, and toner fusion onto members, such as a blade, are liable to occur, because it is required to make the toner layers thinner, and if more than 10 μm, it possibly becomes difficult to obtain a high-resolution and high-quality image, and the variation in the toner particle diameter may become large when toner-balancing in a developer is performed.

The volume-averaged particle diameter can be measured, for instance, through the use of a particle sizer, "Multi-sizer II" manufactured by BECKMAN COULTER Inc.

With respect to the coloring of the toner according to the present invention, there is no particular limitation on it, and it can be selected in accordance with the intended use, and it is possible to use at least any one selected from black toner, cyan toner, magenta toner, and yellow toner, and individual color toners can be obtained by selecting the above-mentioned colorants as necessary.

The toner according to the present invention enables melting viscosity to lower even at low temperature because the toner comprises the amorphous resin and the crystalline resin, and the amorphous resin and the crystalline resin are compatible each other, and the toner enables a drastic decrease in the melting viscosity to the temperature, which leads to a sufficient fixing even at low temperature. In addition, low-temperature fixability of the toner is easily realizable, since the glass-transition temperature of the toner (TgA) of the present invention is lower than the glass-transition temperature (TgC) expressed by the above-stated formula (1). Hence, the toner according to the present invention is suitable for use in high-quality image forming, since the toner excels in various properties, such as charge properties, transferring properties, and fixability, and has excellent hot-offset resistivity and can achieve a balance excellent blocking resistivity and low-temperature fixability.

(Developer)

The developer according to the present invention contains at least the toner of the present invention and other components selected as required, such as a carrier. The developer may be a developer containing a single component and may be a developer containing two components; however, the developer containing two components is preferred in terms of its improved lifetime of printers when used in a high-speed printer responding to the improved information processing speed of recent years.

In the case of the developer containing a single component using the toner of the present invention, even when toner-balancing in the developer is performed, the developer has very little variation in the toner particle diameter, and there is no toner-filming onto developing rollers, and toner fusion onto members, such as a blade, for making the toner layers thinner and allows excellent and stable developing properties and images even over a long period of use of an image developer (agitation). Also, in the case of the developer containing two components using the toner of the present invention, it has very little variation in the toner particle diameters in the developer, and excellent and stable developing properties can be obtained even over a long period of agitation in an image developer.

There is no particular limitation on the carrier, and it can be selected in accordance with the intended use, however, a carrier having a core material and a resin layer coating the core material is preferred.

The material of the above-noted core is not particularly limited and may be selected from among materials known in the art as required. For example, the material based on manganese-strontium (Mn—Sr) of 50 emu/g to 90 emu/g and the material based on manganese-magnesium (Mn—Mg) are preferable. From the perspective of ensuring image density, a ferromagnetic material, such as iron powder (100 emu/g or more), magnetite (75 emu/g to 120 emu/g) or the like is preferred. Also, a material of feeble magnetism, such as Copper-Zinc (Cu—Zn) (30 emu/g to 80 emu/g) is preferable from the perspective of aiming for higher-grade images by means of softening the contact of the toner with the photoconductor where the toner is in a panicle state. Each of these materials may be employed alone or in combination of two or more.

The volume-averaged particle diameter of the above noted core material is preferably 10μm to 150 μm, and more preferably 40 μm to 100 μm.

If the average particle diameter (volume-averaged particle diameter (D50)) is less than 10μm, the amount of fine particles may increase in distribution of carrier particles, and the magnetization intensity per particle may become lower to cause carrier scattering. If more than 150 μm, the specific surface may decrease to cause toner scattering, and in the case of a full-color toner in which there is a large proportion of solid image parts, the reproductivity of the solid image may worsen.

With respect to the material of the resin layer, there is no particular limitation on it, and it can be selected in accordance with the intended use. Examples of the material of the resin layer include an amino resin, a polyvinyl resin, a polystyrene resin, a halogenated-olefin resin, a polyester resin, a polycarbonate resin, a polyethylene resin, a polyvinyl fluoride resin, a vinylidene fluoride resin, a polytrifluoro ethylene resin, a polyhexafluoro propylene resin, a copolymer of vinylidene fluoride and an acrylic monomer, a copolymer of vinylidene fluoride and vinyl fluoride, a fluoro-tarpolymer such as a tarpolymer made from tetrafluoro-ethylene, vinylidene fluoride, and a nonfluorinated fluoride monomer, and a silicone resin. Each of these materials may be employed alone or in combination of two or more.

Examples of the amino resin include a urea-hormaldehyde resin, a melamine resin, a benzo-guanamine resin, an urea resin, a polyamide resin, and an epoxy resin. Examples of the polyvinyl resin include an acrylic resin, a polymethyl methacrylate resin, a polyacrylonitrile resin, a polyvinyl acetate resin, a polyvinyl alcohol resin, and a polyvinyl butyral resin. Examples of the polystyrene resin include a polystyrene resin, a styrene-acrylate copolymer resin. Examples of the halognated-olefin resin include a polyvinyl chloride resin. Examples of the polyester resin include a polyethylene terephthalate resin, and a polybutylene terephthalate resin.

The above-noted resin layer may contain, as required, a conductive powder. Examples of the conductive powder include metal powder, a carbon black, a titanium oxide, a tin oxide, and a zinc oxide. The average particle diameter of the conductive powder is preferably 1 μm or less. If the average particle diameter is more than 1 μm, it possibly becomes difficult to control electric resistance.

The resin layer can be prepared by, for example, the following process. The silicone resin or the like is dissolved in a solvent to prepare a coating solvent, and the coating solvent is evenly coated over the surface of the core material by a coating process known in the art, followed by drying and baking the coated surface. The coating can be performed by, for example, a soaking process, a spraying process, and a blushing process.

The solvent is not particularly limited and may be selected as required as necessary. Examples of the solvent include a toluene, a xylene, a methyl ethyl ketone, a methyl isobutyl ketone, and a butyl cellosolve acetate.

The above-noted baking process is not particularly limited and may be an external heating process or an internal heating process. Examples of the baking process include a process by using a stationary electric furnace, a flow-type electric furnace, a rotary electric furnace, and a burner electric furnace, and a process by using microwave.

The volume of the resin layer in the carrier is preferably 0.01% by mass to 5.0% by mass.

If the above-noted volume is less than 0.01% by mass, the resin layer may not be evenly formed over the surface of the core material, and if more than 5.0% by mass, the resin layer may exceedingly become thick to cause granulation between carriers, and uniform size particles may not be obtained.

When the above-noted developer is a developer containing two components, there is no particular limitation on the developer's content in the carrier, and the content may be selected in accordance with the intended use. For example, the content of the developer in the carrier is preferably 90% by mass to 98% by mass, and more preferably 93% by mass to 97% by mass.

The developer according to the present invention can achieve a good balance between the charge properties with the fixability when forming an image and enables forming high-quality images in a stable manner, as the developer comprises the toner of the present invention.

The developer according to the present invention can be suitably used for image forming by means of various electrophotography processes in the art such as a developing process using one magnetic component, a developing process using one nonmagnetic component, a developing process using two components. The developer, in particular, can be suitably used for the toner container, the process cartridge, the fixing process, the image forming apparatus, and the image forming process according to the present invention, which will hereinafter be described.

(Toner Container)

A toner container according to the present invention is configured to house the toner and the developer of the present invention.

The toner container is not particularly limited and may be selected from among containers in the art. For example, a container having a toner container body and a cap thereof and the like is preferred.

The toner container body itself does not have particular limitations on its size, shape, structure, material, and the like, and these conditions may be selected in accordance with the intended use. For instance, with respect to the shape, a cylindrical container or the like is preferred, and the container is particularly preferred to have spiral-like concavo-convex formed on the circumferential surface to enable the toner of the contents to transfer to the outlet by rotating the container, and to have cornice functions in partial of or the whole of the spiral portion.

As to the material of the toner container, there is no particular limitation on it, and a container precisely made in size is preferable. For instance, resins are suitable. Among the resins, it is preferred to use, for example, a polyester resin, a polyethylene resin, a polypropylene resin, a polystyrene resin, a polyvinylchloride resin, a polyacrylate resin, a polycarbonate resin, an ABS resin, and a polyacetal resin.

The toner container according to the present invention can be easily stored, delivered and allows easy handling. The toner container can be attached to the process cartridge and the image forming apparatus of the present invention or the like, which will hereinafter be described, in an attachable and detachable fashion to be suitably used for toner supply.

(Process Cartridge)

A process cartridge according to the present invention comprises an electrostatic latent image carrier which carries a electrostatic latent image, and a developing unit configured to develop the electrostatic latent image carried on the electrostatic latent image carrier using a developer to form a visible image and further comprises other units selected as necessary.

The above-noted developing unit comprises a developer container for housing the toner and the developer of the present invention, a developer carrier for carrying and delivering the toner and the developer housed in the developer container, and may further comprises a layer thickness controlling member for controlling the thickness of the toner carried.

The process cartridge according to the present invention can be provided onto various electrographic apparatuses in an attachable and detachable fashion and is preferable to be equipped to the image forming apparatus according to the present invention in an attachable and detachable fashion. The image forming apparatus will hereinafter be described.

(Fixing Process)

The fixing process according to the present invention comprises a fixing step and further comprises other steps selected as required.

The fixing step is a step for fixing a transferred image, which is formed by transferring a visible image formed by using the toner of the present invention onto a recording medium, and the fixing step is performed by means of an image fixer. The fixing process may be performed every time each individual color toners is transferred onto the recording medium or at a time in the condition where each individual color toners has been superimposed.

The image fixer is not particularly limited and may be selected in accordance with the intended use, but a heat and pressure unit known in the art is preferable. Examples of the heat and pressure unit include a combination of a pair of fuser rollers that are rotatably pressed against one another (for example, a combination of a heat roller and a pressure roller), and a combination of a heat roller, a pressure roller, and an endless belt.

The pair of fixing rollers is preferably formed with an inelastic member. The inelastic member is not particularly limited and may be selected in accordance with the intended use. Examples of the inelastic member for the fixing rollers include a high-thermal conductive body, such as an aluminum, an iron, a stainless, and a brass. And, it is preferred that the surfaces of the fixing rollers are respectively coated with an offset preventive layer. The material for forming the offset preventive layer is not particularly limited and may be selected in accordance with the intended use. Examples of the material for forming the offset preventive layer include a RTV, a silicone rubber, a tetrafluoroetylene-perfluoro alkyl vinyl ether (PFA), and a polytetrafluoro ethylene (PTFE).

It is preferable that the bearing stress of the contact surface between the fixing rollers (roller load/contact dimension) is low. Specifically, it is required to be $1.5\times10^5$ Pa or less, preferably $1\times10^5$ Pa or less, and more preferably $0.5\times10^5$ Pa. If the bearing stress of the contact surface is in the above numerical range, not only the low-temperature fixability becomes excellent but also the fixing rollers respectively become to have a low thermal capacity, and standby time, from the time when the power of the image fixer is turned on to the time when the image fixer be activated, is shorten to easily allow energy saving.

It is noted that the bearing stress of the contact surface is a value that the load burdened to both ends of the fixing roller is divided by the contact surface dimension. The contact surface dimension of the fixing roller can be obtained by the following lines: A sheet of which the surface nature largely changes by heating, such as an OHP sheet, is passed through between the fixing rollers that have been heated up to a fixable temperature and retained for several tens of seconds in a state of the sheet stopped along the way, and then the sheet is released to obtain the dimension where the surface nature of the sheet has changed.

In addition, in a pair of the fixing rollers, the fixing roller which is contact with the transferred image preferably has a thickness of the portion formed with the inelastic member of 1.0 mm or less, and it is more preferably 0.2 mm to 0.7 mm, although it depends on the strength and the thermal conductivity of the inelastic member. If the thickness of the inelastic member is less than 1.0 mm or less, the temperature raising properties are improved, and it is possible to raise the temperature to the desired one in an extremely short time.

Heating in the heat and pressure unit is preferably performed at 80 ° C. to 200 ° C.

A first aspect of the fixing process of the present invention will be described referring to a fixing apparatus shown in FIG. 1.

A fixing apparatus 1 shown in FIG. 1 comprises a heat roller 2 and a pressure roller 3, which is pressed against the heat roller 2, used as the heat and pressure members (a pair of fixing rollers mentioned above).

The heat roller 2 has a metal cylinder 4 and is formed with the heat roller surface coated with an offset preventive layer 5 and has a heat lamp 6 provided therein.

The pressure roller 3 has a metal cylinder 7 with the pressure roller surface coated with an offset preventive layer 8. The pressure roller 3 may have a heat lamp 9 provided therein.

The heat roller 2 and the pressure roller 3 are rotatably provided in a crimped state by biasing them by means of a spring not shown in FIG. 1.

In the image fuser shown in FIG. 1, first a recording medium S in which a toner image T to be fixed is formed is delivered to the nip portion between the heat roller 2 and the pressure roller 3. Then the toner image T on the recording medium S is heated and melted in a molten state by the heat roller 2 and the pressure roller 3 which have been heated up to a specified temperature by the action of the heat lamp 6 as well as is pressed by means of the pressing force of the press roller 3 at the time when the toner image T is passing through the nip portion; thus, the toner image T is fixed on a recording medium S.

According to the fixing process of the present invention, a transferred image formed by using the toner of the present invention having high sharp melt properties is fixed on the recording medium. As a result, a highly sharp and high quality image in high image density can be obtained under low-temperature fixing conditions without any hot offset occurrences. Also, a transferred image is effectively fixed with very little thermal loss, because the image is fixed on the recording medium through the fixing rollers having a low bearing stress and a low thermal capacity.

Further, another aspect of the fixing process according to the present invention may be a process using a fixing apparatus which comprises magnetic field generating unit, and a heat and pressure unit in which at least a rotation and heat member having at least a heat generation layer for generating heat by means of electromagnetic induction and a demolding layer are disposed; and a rotation and pressure member in which the rotation and heat member and the nip portion are formed, a transferred image made from the toner transferred on a recording medium is pressed and heated to fix the transferred image on the recording medium while the pressure roller pressing the transferred image through the recording medium in the fixing nip portion. The aspect of the fixing process also allows ensuring low-temperature fixability more than ever before and a wide range of fixing temperature. Particularly, in the aspect above, it is also easy to ensure enwinding resistivity in addition to the hot-offset resistivity, and therefore, the aspect of the fixing process is suitable for fixing a full-color toner where little elastic components are often provided for increasing melting properties.

In the image fixer, it has only to have at least a heat generation layer and a demolding layer disposed therein, and an elastic material layer may also be disposed between the heat generation layer and the demolding layer for the purpose of improving color mixture properties as an image fixer for color images where thick toner layers are superimposed.

Figure 2:
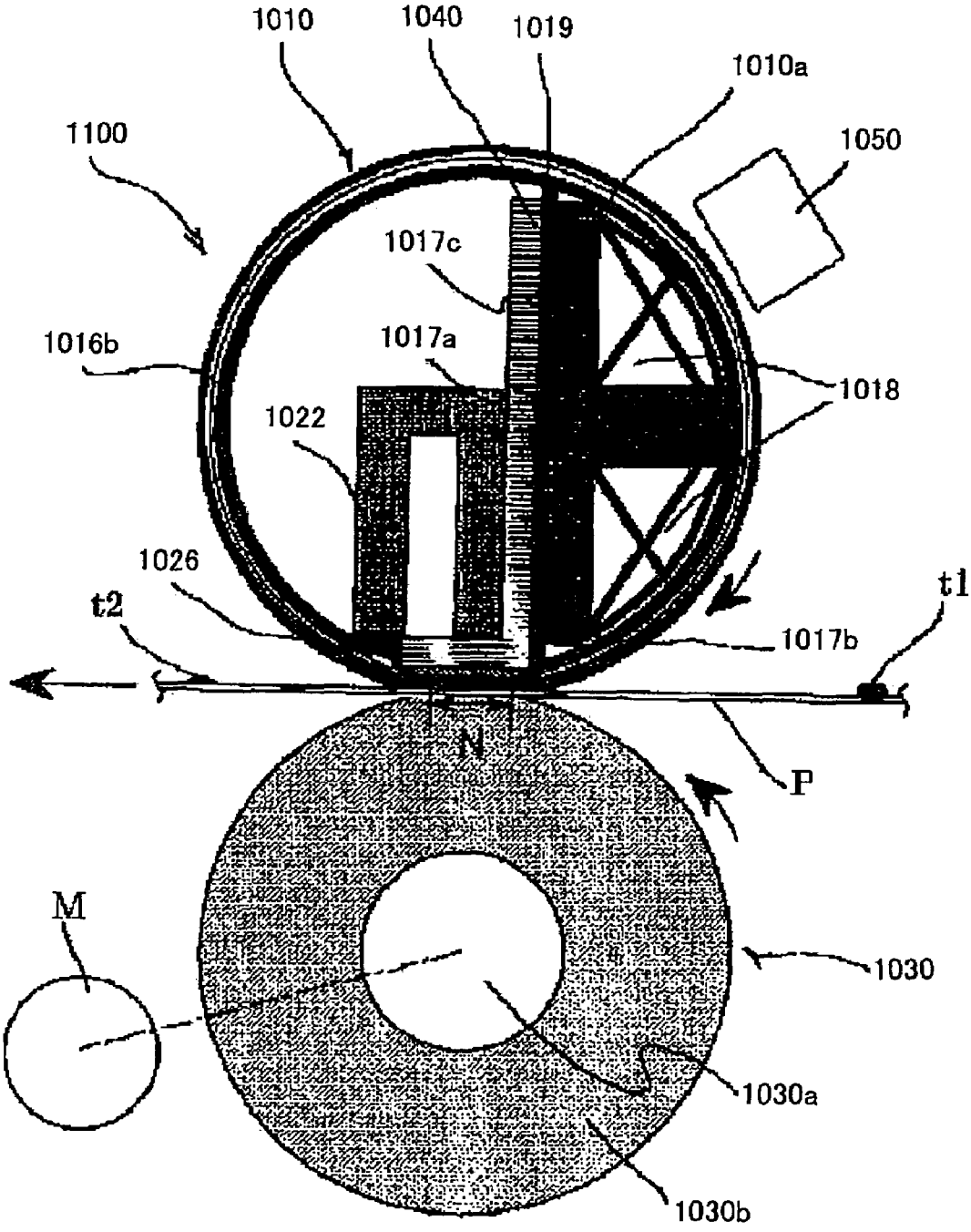
FIG. 2 is a schematic view showing another example of executing the fixing process according to the present invention.
Figure 3:
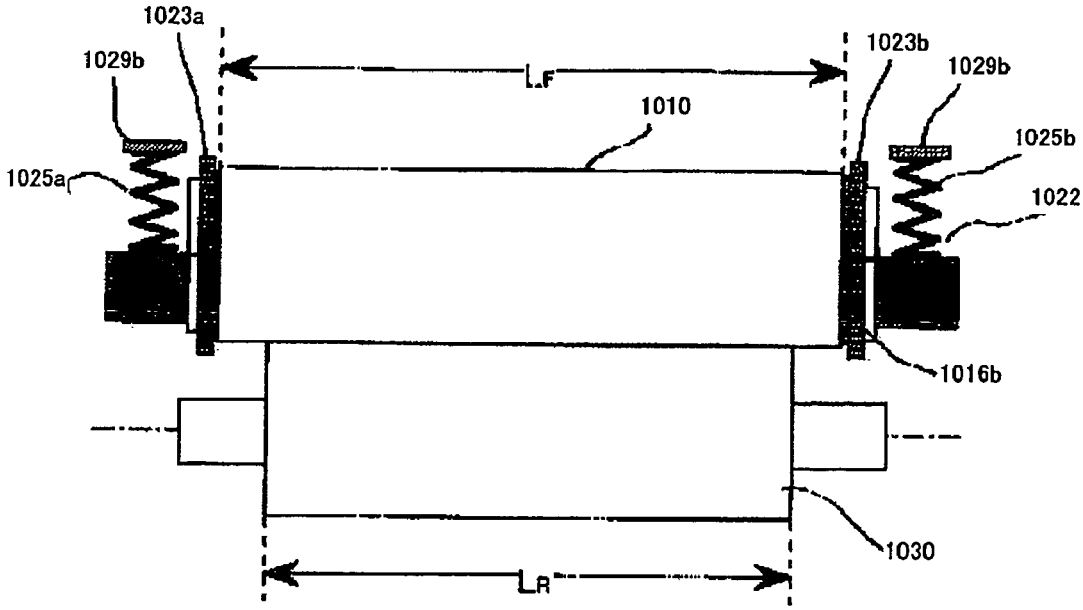
FIG. 3 is a front view schematically showing the substantial part of the image fixer illustrated in FIG. 2.
Figure 4:
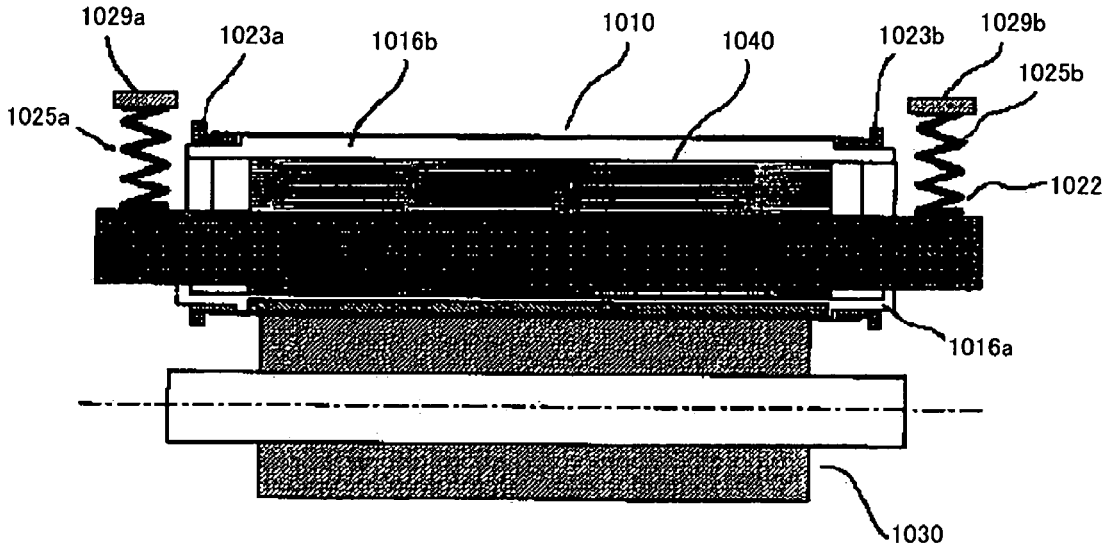
FIG. 4 is a longitudinally front view schematically showing the substantial part illustrated in FIG. 2.

FIG. 2 is a cross-sectional side view schematically showing the substantial part of the image fixer based on the electromagnetic induction process (1100). FIG. 3 is a front view schematically showing the substantial part of the image fixer, and FIG. 4 is a longitudinally front view specifically showing the substantial part of the image fixer, and showing an example of the image fixer having a rotation and heat member with an elastic material layer disposed in addition to a heat generation layer and a demolding layer. FIG. 2 is just an example, and the configuration may be changed as necessary. For example, a configuration with the exciting coil section provided at outside of the belt may be used.

The image fixer 1100 in FIG. 2 is an apparatus based on a pressure roller driving process and electromagnetic induction heating process, using a cylindrical electromagnetic induction-based exothermic belt. The cylindrical fixer film 1010 has electromagnetic induction heat generation layers (electrically conductive layer, magnetic body layer, and resistor body layer) and serves as an electromagnetic induction exothermic rotator.

A magnetic field generation unit comprises magnetic cores 1017*a*, 1017*b*, and 1017*c*; and an exciting coil 1018.

The magnetic cores 1017*a*, 1017*b*, and 1017 are made from high magnetic permeability materials, and materials used for cores of transformers such as a ferrite and a permalloy are preferably used for the magnetic cores. It is preferable to use a ferrite, which has little loss of the material even in 100 kHz or more.

Figure 5:
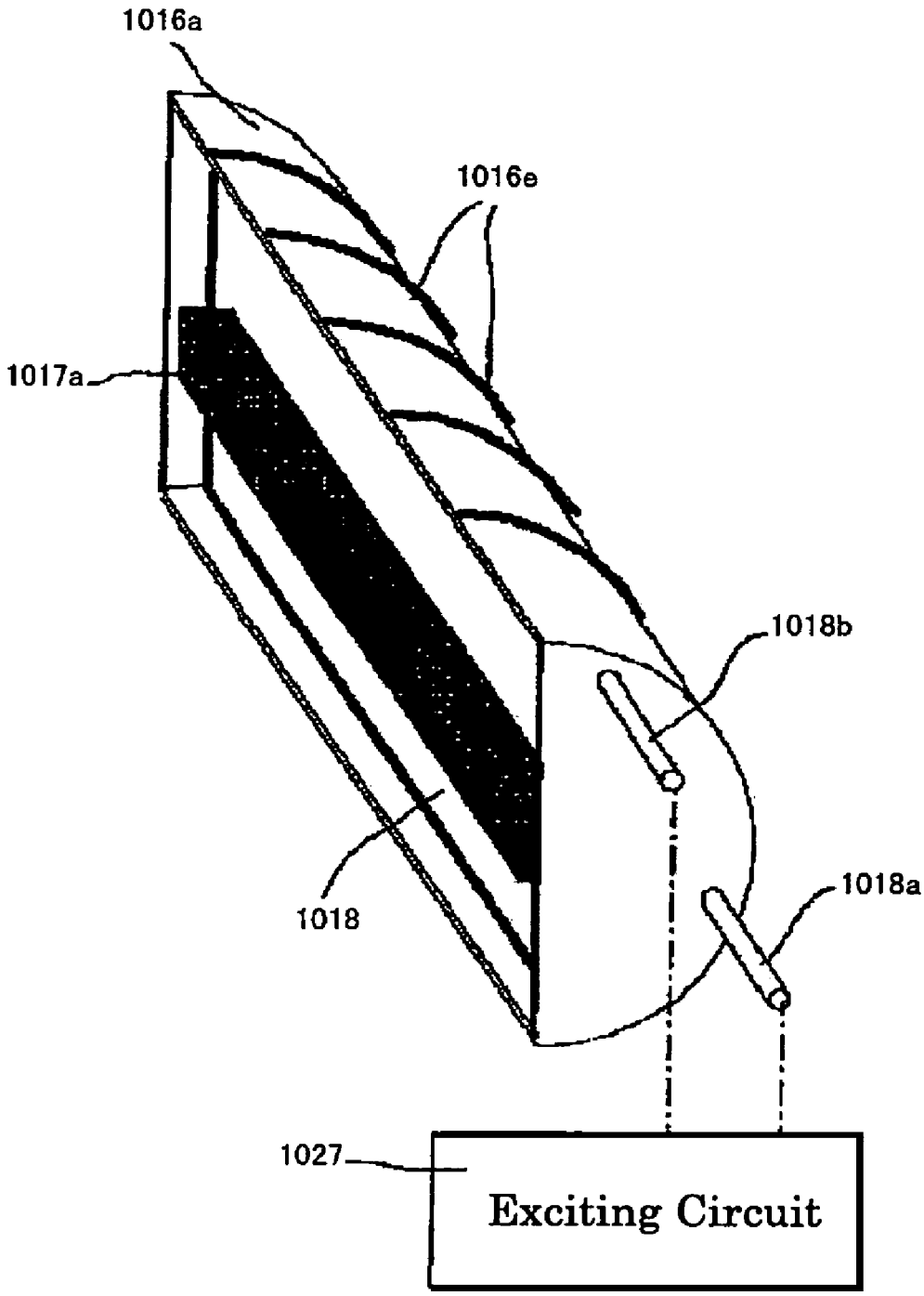
FIG. 5 is a view schematically showing the magnetic field generating unit relating to the image fixer illustrated in FIG. 2.

In an exciting coil 1018, as shown FIG. 5, an exciting circuit 1027 is connected to the power supplying portions of 1018*a* and 1018*b*. The exciting circuit 1027 is configured to enable generating high frequency wave ranging from 10 kHz to 500 kHz by a switching power source.

The exciting coil 1018 generates alternating magnetic flux induced by alternating current (high-frequency current) supplied from the exciting circuit 1027. 1016*a* and 1016*b* are belt members, which are generally semi-circular trough-shaped seen from a cross-sectional view. Their openings are arranged face to face to form a generally cylindrical body, and a fixing belt 1010, which is a cylindrical electromagnetic induction generation belt, is loosely outfitted at the outer side of the belt guide members.

The belt guide member 1016a has the magnetic cores of 1017*a*, 1017*b*, and 1017*c* as a magnetic field generation unit, and the exciting coil 1018 inside of the belt guide member.

In the belt guide member 1016*a*, as shown FIG. 4, a high thermal conductivity member 1040 that is longitudinally seen in the vertical direction on the drawing sheet is provided on the counter side of the pressure roller 1030 on the nip portion N at the inner side of the fixing belt of 1010.

In this example, aluminum is used for the high thermal conductivity member 1040. The high thermal conductivity member 1040 has a thermal conductivity of k=240 [W·m−1·K−1] and a thickness of 1 mm.

The high thermal conductivity member 1040 is also provided outside of the magnetic field so that the member 1040 is not affected by the magnetic fields generated from the exciting coil 1018 and the magnetic cores of 1017*a*, 1017*b*, and 1017*c*, all of which are a magnetic field generating unit.

Specifically, the high thermal conductivity member 1040 is arranged at the position where the magnetic core 1017*c* is separated from the exciting coil 1018 and disposed outside of the magnetic pass of the exciting coil 1018 so that the exciting coil does not exert an influence upon the good thermal conductivity member.

A horizontally extended rigid stay for pressure 1022 is arranged so as to directly come into contact with the inner side plane portion of the belt guide member 1016*b*.

An electrical insulating member 1019 provides electrical insulator between the magnetic core 1017*a*, 1017*b*, 1017*c*; the exciting coil 1018; and the rigid stay for pressure 1022

Flange members 1023*a* and 1023*b* are outfitted at both right and left sides of the assembly of the belt guide members 1016*a* and 1016*b* and rotatably mounted, while being fixed, to the both sides of the assembly of the belt guide members to play a role for controlling movements longitudinally along with the belt guide member of the fixing belt by catching on the end of the fixing belt 1010 at the time of the fixing belt 1010 rotating.

The pressure roller 1030 as a pressure member comprises a cored bar 1030*a* and a heat-resistant and elastic material layer 1030*b* which is made from silicone rubber, fluorocarbon rubber, fluorocarbon resin or the like, and concentrically coated around the cored bar 1030*a* and formed in a roller shape, and the pressure roller 1030 is arranged with both ends of the cored bar 1030*a* rotatably held as bearing between sheet metals on the chassis side (not shown) of the image fixer.

By providing pressure springs 1025*a* and 1025*b* between either ends of the rigid stay for pressure 1022 and spring bearing members 1029*a* and 1029*b* respectively in a state of the pressure springs being shriveled, it helps the stay for pressure 1022 exert its press-down force, thereby the undersurface of the belt guide member 1016*a* and the upper surface of the pressure roller 1030 are pressed in contact through the fixing belt 1010 to form the fixing nip portion N having a specified width.

The pressure roller 1030 is driven to rotate in the direction indicated by the arrow by a drive unit M. The friction force between the pressure roller 1030 and the outer surface of the fixing belt 1010 torques the fixing belt 1010, and the fixing belt 1010 rotates around the outer circumference of the belt guide members 1016*a* and 1016*b* at a peripheral velocity nearly responding to the rotating peripheral velocity of the pressure roller 1030 in the direction indicated by the arrow with the inner surface of the fixing belt sliding in close contact with the undersurface of the good thermal conductivity member 1040 in the fixing nip N.

In this case, to reduce the mutual sliding friction force between the undersurface of the good thermal conductivity member 1040 and the inner surface of the fixing belt 1010 in the nip portion N, a lubricant such as heat-resist grease may be interposed between the undersurface of the good thermal conductivity member 1040 and the inner surface of the fixing belt 1010 in the nip portion N, or the undersurface of the good thermal conductivity member 1040 may be coated with a lubricating member. This prevents the sliding fixing belt 1010 from developing a flaw to decrease the durability of the belt 1010 when the smoothness characteristics of the surface are not good in terms of quality of material or when the finishing touches are simplified, as in the case of aluminum being used for the good thermal conductivity member 1040.

The good thermal conductivity member 1040 has effect for equalizing a temperature distribution in the longitudinal direction. For instance, when a small size paper is passed through the fixing belt 1010, the heating value of heat of not-paper passed portion in the fixing belt 1010 is transferred to the good thermal conductivity member 1040 to thermally conduct the heating value of not-paper-passed portion to the paper-passed portion of the small sized paper, and the effect for reducing the power consumption in the case of a small-sized paper being passed through can be also obtained.

As shown in FIG. 5, a convex-rib part 1016*e* is formed with a predetermined space provided longitudinally at the curved surface of the belt-guide member 1016*a* to reduce the contact sliding resistivity between the curved surface of the belt-guide member 1016*a* and the inner surface of the fixing belt 1010 and then to reduce the rotating load of fixing belt 1010.

Such a convex rib part can be also provided at the belt-guide member 1016*b* in a similar way.

Figure 6:
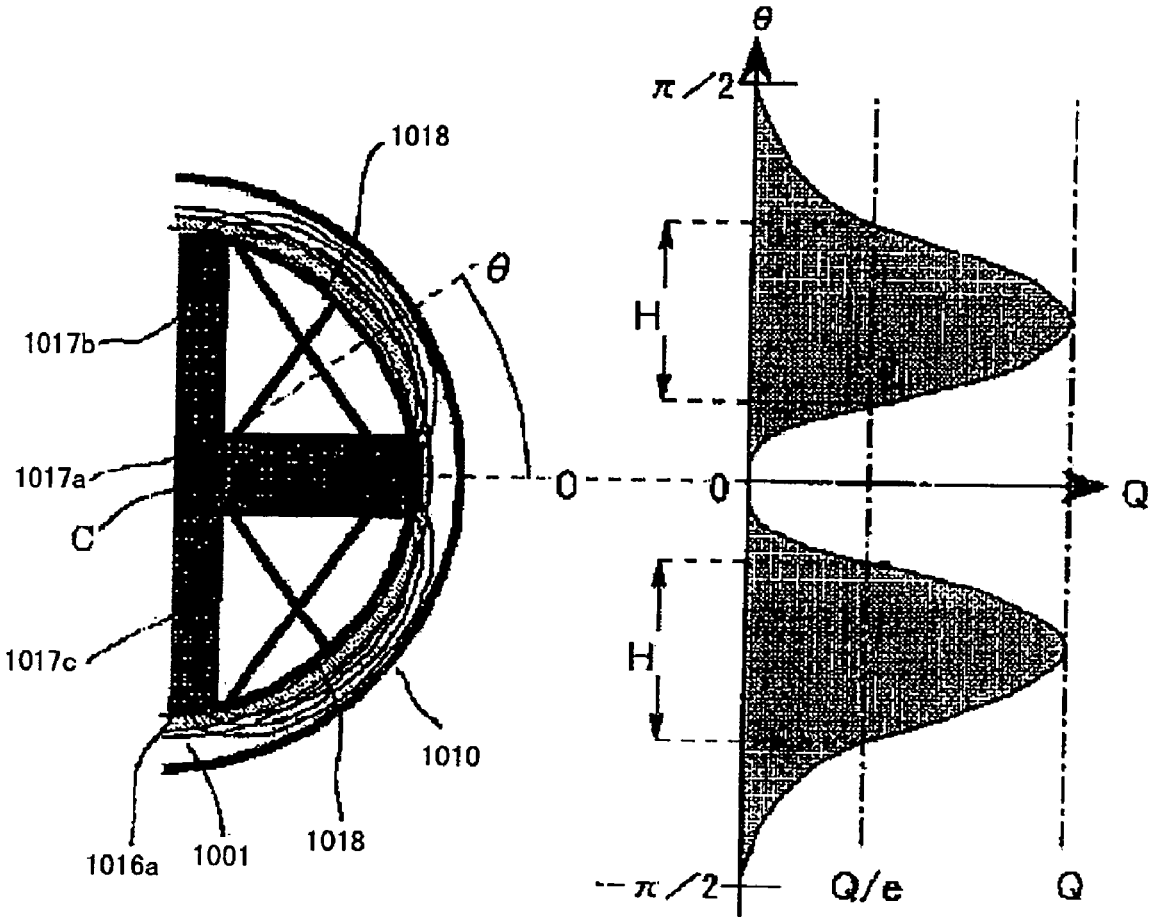
FIG. 6 is a view schematically showing generation of an alternating magnetic flux.

FIG. 6 shows schematic representation of the induction of an alternating magnetic flux. Magnetic flux C represents a portion of the induced alternating magnetic flux. The alternating magnetic flux C generated by the magnetic cores of 1017*a*, 1017*b*, and 1017*c* induces eddy-current between the magnetic core 1017*a* and the magnetic core 1017*b*, and between the magnetic core 1017*a* and the magnetic core 1017*c* on the electromagnetic induction heat generating layer 1001 of the fixing belt 1010. The eddy-current induces Joule heat (eddy-current loss) in the electromagnetic induction heat generating layer 1001 depending on the specific resistance of the electromagnetic induction heat generating layer 1001. The heating value Q here is determined by the density of magnetic flux passing through the electromagnetic induction generating layer 1001 and shows the distribution shown in the graph in FIG. 6. In the graph shown in FIG. 6, the vertical axis represents the circumferential position in the fixing belt 1010 expressed by the angle θ when the center of the magnetic core 1017*a* being 0 (zero), and the horizontal axis represents the heating value Q at the electromagnetic induction heat generating layer 1001 of the fixing belt 1010. Here, a heating area H is defined as an area having the heating value of Q/e or more, when the maximum heating value being Q. This area corresponds to the region where the heating value exceeds the value required for the fixation.

The temperature of the fixing nip portion N is adjusted so that a given temperature can be maintained by controlling the current supply to the exciting coil 1018 by means of a temperature control system comprising a temperature detecting unit (not shown). In the example, a temperature sensor 1026 such as a thermistor for detecting the temperature of the fixing belt 1010 is provided to control the temperature of the fixing nip portion N based on the temperature information of the fixing belt 1010 measured by the temperature sensor 1026.

Under the conditions where the fixing belt 1010 rotates and is heated through electromagnetic induction by means of the rotation of the fixing belt 1010 and power feeding from an exciting circuit 1027 to the exciting coil 1018, as stated above, to make the temperature at the fixing nip portion N raised up to a given temperature and controlled, the image surface of a recording material P in which a not-fixed toner image t1 carried from the image forming unit section is formed turns up between the fixing belt 1010 at the position of the fixing nip portion N and the pressure roller 1030, namely, the image surface (the recording material P) is introduced in opposition to the fixing belt surface, and in the fixing nip portion N, the image surface comes into closely contact with the outer surface of the fixing belt 1010 to be carried with the fixing nip portion N nipped together with the fixing belt 1010. In the process the recording material P is nipping the fixing nip portion N to carry it together with the fixing belt 1010, the not-fixed toner image t1 on the recording material P is heated and fixed by heat generation through electromagnetic induction of the fixing belt 1010. When the recording material P passed through the fixing nip portion N, it is separated from the outer surface of the rotating fixing belt 1010 to be discharged and carried. The heated and fixed toner image on the recording material will be cooled to be a permanently fixed image after passing through the fixing nip portion N.

As another aspect of the fixing process according to the present invention, it may be a fixing process using an image fixer having a heat roller comprising a magnetic metal and heated by electromagnetic induction; a fixing roller placed in parallel with the heat roller; an endless belt-shaped toner heating medium which is spanned over the heat roller and the fixing roller to be heated by the heat roller as well as rotated by these rollers; and a pressure roller which is brought into pressure contact with the fixing roller through the toner heating material as well as rotates forwardly relative to the toner heating medium to form a fixing nip portion, a transferred image made from the toner transferred on a recording medium is pressed and heated to fix the transferred image on the recording medium while the pressure roller pressing the transferred image through the recording medium in the fixing nip portion. The aspect also enables ensuring a lower temperature fixing and a wider range of fixing temperatures more than ever.

The aspect of the present invention is particularly suited for a fixing apparatus for full-color images where a plurality of toner colors needs to be sufficiently melted for developing, since a wide nip width is easily secured.

Figure 7:
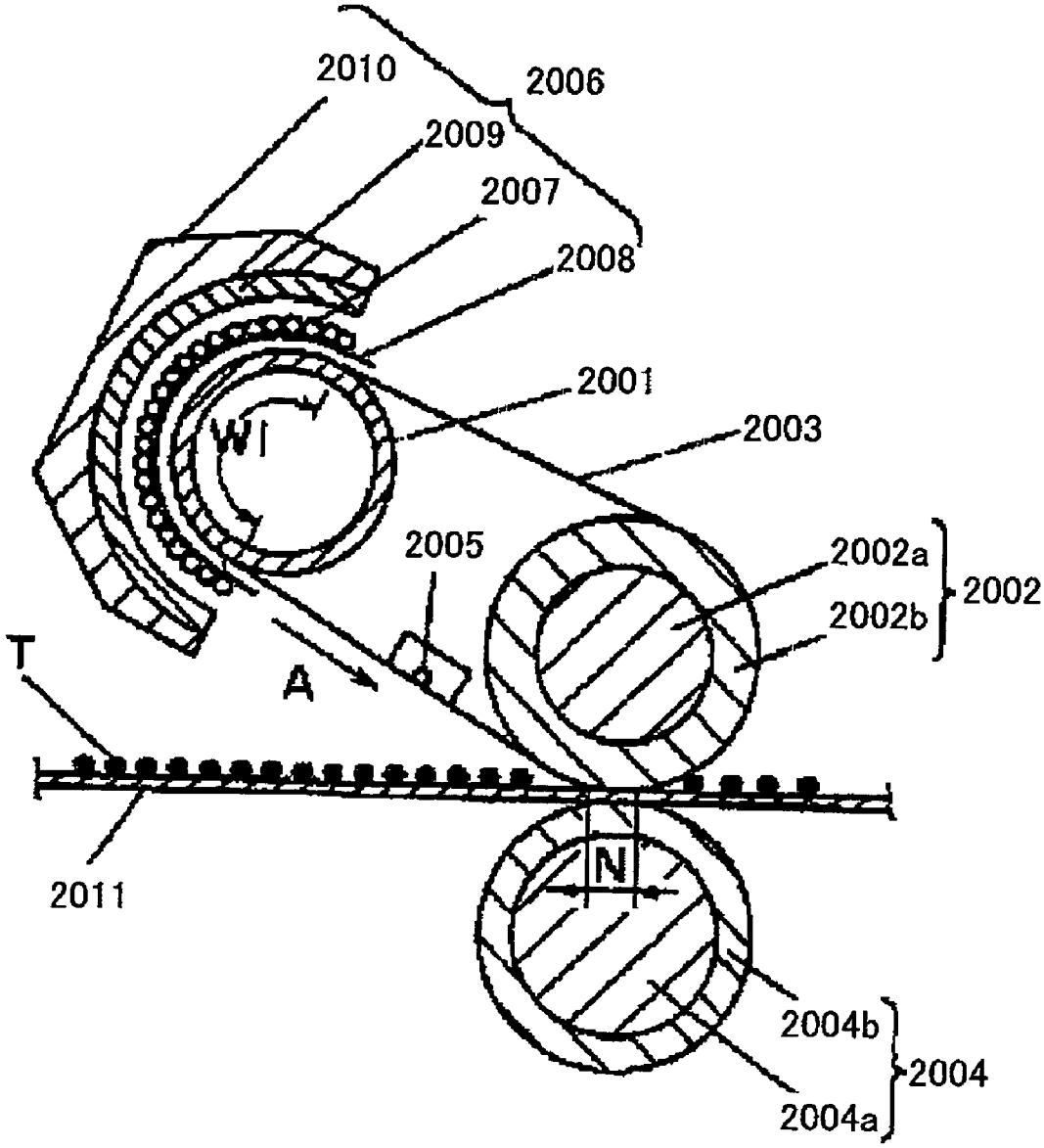
FIG. 7 is a schematic view showing another example of executing the fixing process according to the present invention.

FIG. 7 shows an example of the image fixer. The image fixer shown in FIG. 7 comprises a heat roller 2001 heated by electromagnetic induction of an electromagnetic induction heating unit 2006; a fixing roller 2002 placed in parallel with the heat roller 2001; an endless-shaped heat resistant belt (toner heating medium) heated by the heat roller 2001 and rotated in the direction shown with an arrow A by at least any one of the rollers; and a pressure roller 2004 which is pressed to the fixing roller 2002 through a belt 2003 and rotates forwardly relative to the belt 2003.

The heat roller 2001 is a hollow-body and cylindrical-shape made of a magnetic metal member, such as iron, cobalt, nickel, or an alloy thereof and is configured to have a fast temperature rising property with a low thermal capacity, for example, designed to have an outer diameter of 20 mm and a wall thickness of 0.1 mm.

The fixing roller 2002 comprises, a cored bar 2002*a* made from a metal such as stainless-steel; and an elastic member 2002*b* coating the cored bar 2002*s* with a heat-resistant silicone rubber in a solid or foamed condition. Furthermore, to form a contact area having a given width between the pressure roller 2004 and the fixing roller 2002 by means of pressuring force from the pressure roller 2004, the outer diameter of the fixing roller 2002 is designed to be 40 mm and is made larger than that of the heat roller 2001. The elastic member 2002*b* is designed to have a wall thickness of about 3 to 6 mm, and a hardness of about 40° to 60° (Asker hardness). The configuration makes the heat roller 2001 quickly heated to shorten the warm-up time, because the thermal capacity of the heat roller 2001 becomes smaller than that of the fixing roller 2002.

The belt 2003 spanned over the heat roller 2001 and the fixing roller 2002 is heated at the area W1 which is in contact with the heat roller 2001 heated by action of an electromagnetic induction heating unit 2006. And the inner surface of the belt 2003 is continuously heated by rotations of the rollers of 2001 and 2002 to be consequently heated throughout the belt.

The thickness of a demolding layer 2003*b* is preferably about 50 μm to 500 μm, and particularly preferably about 200 μm. This will make the surface layer of the belt 2003 possible to fully wrap around the toner image T formed on a recording material 2011 to heat and melt the toner image evenly.

If the thickness of the demolding layer 2003*b* is thinner than 100 μm, the thermal capacity of the belt 2003 becomes lower, and the belt surface temperature rapidly lowers in the toner fixing process, and it is impossible to sufficiently ensure the fixability. If the thickness of the demolding layer 2003*b* is thicker than 500 μm, the thermal capacity of the belt 2003 becomes larger to extend the time for warm-up. In addition, in the toner fixing process, it becomes harder to make the belt surface temperature decrease to cause the so-called hot offset phenomenon where flocculation effect of the toner dissolved at the exit of fixed portion cannot be obtained, and toner releasing properties of the belt decreases to make toner adhered to the belt.

As for a base material of the belt 2003, a resin layer having heat resistance, such as a fluorocarbon resin, a polyimide resin, a polyamide resin, a polyamide-imide resin, a PEEK resin, a PES resin, and PPS resin may be used, instead of using a heat generation layer 2003*a* comprising the above mentioned metals.

The pressure roller 2004 comprising a cored bar 2004*a* made from a cylindrical member of a high-thermal conductive metal such as copper or aluminum; and an elastic member 2004*b* having high heat resistance and toner releasing properties provided on the surface of the cored bar 2004*a*. In addition to the above-noted metals, SUS may be used for the cored bar 2004*a*.

The pressure roller 2004 presses the fixing roller 2002 through the belt 2003 to form the fixing nip portion N. In this aspect, by making the hardness of the pressure roller 2004 harder than that of the fixing roller 2002, the formation that the pressure roller 2004 makes inroads into the fixing roller 2002 (and the belt 2003) is taken, thereby it is possible to give the effect to facilitate a recording material 2011 separating from the surface of the belt 2003, because the recording material 2011 is arranged along the circumferential shape of the surface of the pressure roller 2004. The outer diameter of the pressure roller 2004 is about 40 mm, as in the outer diameter of the fixing roller 2002 but has a wall thickness of about 1 mm to about 3 mm, which is thinner than that of the fixing roller 2002, and the pressure roller 2004 is, as described above, configured to become harder than the fixing roller 2002, to have a hardness of about 50° to about 70° (Asker hardness).

Figure 8A:
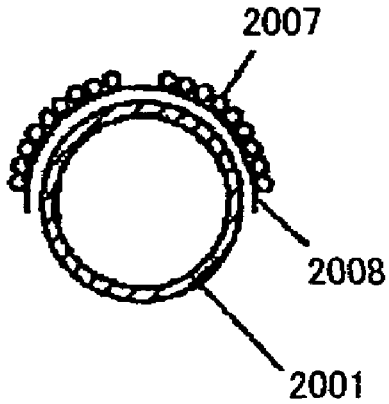
FIG. 8A is a cross-sectional view showing the arrangement of an exciting coil as the induction heating unit in the image fixer illustrated in FIG. 7.
Figure 8B:
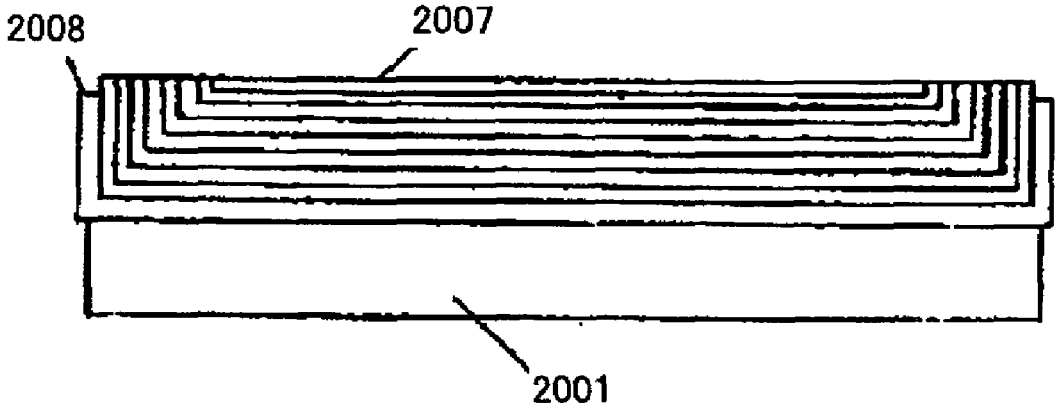
FIG. 8B is a side view showing the arrangement of an exciting coil of the induction heating unit in the image fixer illustrated in FIG. 7.

The electromagnetic induction heating unit 2006 which heats the heat roller 2001 by means of electromagnetic induction has, as shown in FIG. 7 and FIG. 8*a* and FIG. 8*b*, an exciting coil 2007 as a magnetic field generating unit; and a coil guide plate 2008 to which the exciting coil 2007 is rolled up. The coil guide place 2008 is disposed closely to the outer circumferential surface of the heat roller 2001 in a half cylinder shape. As shown in FIG. 8*b*, the exciting coil 2007 is the one that a long exciting coil wire rod is alternately rolled up along the coil guide plate 2008 in the axial direction of the heat roller 2001.

It is noted that the oscillation circuit of the exciting coil 2007 is connected to a frequency-variable driving power source (not shown).

At the outside of the exciting coil 2007, an exciting coil core 2009 which is made from a ferromagnetic element, such as ferrite and is in a half cylinder shape is fixed to an exciting coil core supporting member 2010 and closely disposed to the exciting coil 2007. It is noted that in the aspect of the present invention an exciting coil core 2009 having a relative permeability of 2500 is used.

A high-frequency alternating current of 10 kHz to 1 MHz, and preferably 20 kHz to 800 kHz is supplied from the driving power source to the exciting coil 2007, thereby an alternate magnetic field occurs. The alternate magnetic field works on the heat roller 2001 and the heat generation layer 2003*a* of the belt 2003 at the contact area W1 of the heat roller 2001 and the heat-resistant belt 2003 and in the vicinity thereof. Inside of them, eddy currents I flow in the direction that prevents alternate magnetic field changes.

The eddy currents I induce the Joule heat depending on the resistances of the heat roller 2001 and the heat generation layer 2003*a* to make the belt 2003, which has the heat roller 2001 and the heat generation layer 2003*a*, heated by means of electromagnetic induction mainly in the contact area between the heat roller 2001 and the heat generation layer 2003*a* and the vicinity thereof.

In the present invention, the use of the toner according to the present invention is particularly effective in a fixing process where a electrostatic latent image is fixed on a recording paper having a smoothness level of 20 sec to 35 sec. Using the toner of the present invention, which has sharp melt properties and the melting viscosity, which becomes low at low temperature, makes it easy to carry out fixing at low temperature even with a recording paper having low level of smoothness that the adhesiveness is worse and is liable to become harder to ensure fixing intensity.

The smoothness levels in the present invention can be measured by using a tester defined by the paper-pulp testing process No. 5-2:2000 (paper and paperboard—smoothness level and air permeability level testing process—the second section: Oken process).

(Image Forming Process and Image Forming Apparatus)

The image forming process according to the present invention includes at least a electrostatic latent image forming step, a developing step, a transferring step, and a fixing step, and further includes other steps selected in accordance with the intended use, such as a charge-eliminating step, a cleaning step, a recycling step, and a controlling step.

The image forming apparatus of the present invention comprises a electrostatic latent image carrier, a electrostatic latent image forming unit, a developing unit, a transferring unit, and an image fixer, and further comprises other units selected in accordance with the intended use, such as a charge-eliminating unit, a cleaning unit, a recycling unit, and a controlling unit.

The electrostatic latent image forming step is a step for forming a electrostatic latent image on a electrostatic latent image carrier.

The electrostatic latent image carrier (may be referred to as "photoconductive insulator" or "photoconductor") is not particularly limited as to the material, shape, structure, size, and the like and may be selected among from electrostatic latent image carriers in the art, but it is preferably a drum-like in shape, and the examples of the material include an inorganic photoconductor such as an amorphous silicone, and selenium; and an organic photoconductor such as polysilance, and phthalo polymetine. Among these materials, an amorphous silicone or the like is preferred in terms of the longer operating life.

The electrostatic latent image can be formed, after charging the surface uniformly, by exposing the surface of the electrostatic latent image carrier according to the image, and the image forming can be performed by means of the electrostatic latent image forming unit.

The electrostatic latent image forming unit comprises a charger for charging the surface of the electrostatic latent image carrier uniformly and an exposer for exposing the surface of the electrostatic latent image carrier imagewise.

The charge can be performed by applying voltage to the surface of the electrostatic latent image carrier through the use of the charger.

There is no particular limitations on the charger, and it can be selected in accordance with the intended use. Examples of the charger include a contact-type charger, known in the art, which includes a conductive or semi-conductive roll, a brush, a film, rubber blade, or the like; and a noncontact-type charger which utilizes corona discharge such as corotron, and scorotron.

The exposures can be performed by exposing the surface of the electrostatic latent image carrier using the exposer.

The exposer is not particularly limited provided that exposures can be performed imagewise, as in the appearance of the image to be formed, on the surface of the electrostatic latent image carrier, and it can be selected in accordance with the intended use. There are various examples of the exposer, such as a photocopy optical system, a rod lens array system, a laser beam system, and a liquid-crystal shutter.

It is noted that in the present invention, an optical backside process may be employed.

Developing Step and Developing Unit

The developing step is a step for developing the electrostatic latent image using the toner and the developer of the present invention to form a visible image.

Forming of the visible image can be performed by developing the electrostatic latent image using, for instance, the toner and the developer of the present invention and by means of the developing unit.

The developing unit is not particularly limited provided that image developing can be performed using the toner and the developer of the present invention, and it can be selected among from developing units known in the art. Examples of the developing unit include the one that houses the toner and the developer of the present invention and has at least an image developer which can supply the toner and the developer in contact with or in not contact with the electrostatic latent image, and more preferably an image developer which further comprises the toner container of the present invention.

The image developer may be based on a dry-process process or a wet-process process, and also may be an image developer for monochrome or for multicolor, and for example, an image developer which includes an agitator for frictionizing and agitating the toner and the developer to be charged; and a rotatable magnet roller, is preferable.

In the image developer, for example, the toner and the carrier are mixed and agitated, and the toner is charged by friction at that time to be held in the state where the toner is standing on the surface of the rotating magnet roller to form a magnetic brush. Since the magnet roller is disposed in the vicinity of the electrostatic latent image carrier (photoconductor), a part of the toner constituting the magnet brush formed on the surface of the magnet roller moves onto the surface of the electrostatic latent image carrier (photoconductor) by electrical attraction force. As a result, the electrostatic latent image is developed through the use of the toner to form a visible image based on the toner on the surface of the electrostatic latent image carrier (photoconductor).

A developer to be housed to the image developer is the one that contains the toner of the present invention, and it may be a developer containing one component or two components. A toner included in the developer is the toner of the present invention.

Transferring Step and Transferring Unit

The transferring step is a step for transferring the visible image to a recording medium, and an aspect that a visible image is primarily transferred onto an intermediate image-transfer member and then the visible image is secondary transferred to a recording medium is preferable. And an aspect that includes a primary transferring step for primarily transferring a visible image onto an intermediate image-transfer member using two or more colors for the toner, preferably a full-color toner to form a complex transferred image; and a secondary transferring step for transferring the complex transferred image onto a recording medium is more preferable.

The transfer printing can be carried out by charging the electrostatic latent image carrier (photoconductor) through the use of, for example, the above-noted charger for transferring a visible image and by means of the transferring unit. As the transferring unit, it is preferred that an aspect includes a primary transferring unit for transferring a visible image onto an intermediate image-transfer member to form a complex transferred image; and a secondary transferring unit for transferring the complex transferred image onto the recording medium.

It is noted that the intermediate image-transfer member is not particularly limited and may be selected among from intermediate image-transfer members known in the art in accordance with the intended use. Favorable examples of the intermediate image-transfer member include an image-transfer belt.

With respect to the transferring unit (the primary transferring unit and the secondary transferring unit), it is preferable to include at least a transcriber for exfoliating the visible image formed on the electrostatic latent image carrier (photoconductor) to be charged onto the recording medium side. The transferred unit may include a single unit or two or more units.

Examples of the transcriber include a corona transcriber, a transcription belt, a transcription roller, a pressure transcription roller, and an adhesion transcriber.

And, the recording medium is not particularly limited and may be selected among from recording media (recording papers) known in the art.

The fixing step is a step for fixing a visible image transferred onto a recording medium by using a fixing apparatus, and the fixing step may be performed every time each individual color toners is transferred onto the recording medium or at a time in the condition where each individual color toners has been superimposed.

The image fixer is not particularly limited and may be selected in accordance with the intended use, but a heat pressure unit known in the art is preferable. Examples of the heat pressure unit include a combination of a heat roller and a pressure roller, and a combination of a heat roller, pressure roller and an endless belt.

The heating temperature in the heat pressure unit is preferable 80 ° C. to 200 ° C.

It is noted that in the present invention, for example, an optical fixing apparatus known in the art may be used together with the fixing step and the fixing unit or instead of them, in accordance with the intended use.

The charge-eliminating step is a step for eliminating electricity by applying charge-eliminating bias to the electrostatic latent image carrier, and it can be suitably performed by means of a charge-eliminating unit.

The charge-eliminating unit is not particularly limited and may be required only to have the ability for applying charge-eliminating bias to the electrostatic latent image carrier, and this can be suitably performed by a charge-eliminating unit. It is possible to select a charge-eliminating unit among from electricity eliminators known in the art. For example, a charge-eliminating lamp is suitable.

The cleaning step is a step for removing the electrographic toner residues remaining on the electrostatic latent image carrier, and the step can be suitably performed by means of a cleaning unit.

There is no particular limitation on the cleaning unit, and the unit is required only to have the ability for removing the electrographic toner residues remaining on the electrostatic latent image carrier, and may be selected as a suitable one among from cleaners known in the art, such as a magnetic brush cleaner, an electrostatic brush cleaner, a magnetic roller cleaner, a blade cleaner, a brush cleaner, and a web cleaner.

The recycling step is a step for recycling the electrographic color toner eliminated by means of the cleaning step to the developing unit and can be carried out by means of a recycling unit.

The recycling unit is not particularly limited, and a carrier means known in the art may be used.

The controlling unit is a step for controlling the above-noted individual steps, and this can be suitably performed by a controlling unit.

The controlling unit is not particularly limited provided that the movements of the above noted individual steps can be controlled, and may be selected in accordance with the intended use. Examples of the controlling unit include an instrument such as a sequencer, and a computer.

An aspect of performing the image forming process according to the present invention through the use of the image forming apparatus of the present invention will be illustrated with reference to FIG. 9. The image forming apparatus 100 shown in FIG. 9 includes a photoconductor drum 10 (hereinafter briefly referred to as "photoconductor 10") as the electrostatic latent image carrier, a charge roller 20 as the charging unit, a exposer 30 as the exposing unit, an image developer 40 as the developing unit, an intermediate image-transfer member 50, a cleaner 60 serving as the cleaning unit with a cleaning blade provided therein, and a charge-eliminating lamp 70 as the charge-eliminating unit.

The intermediate image-transfer member 50 is an endless belt, and designed such that the member is spanned over three rollers 51 disposed inside thereof and driven in the direction indicated by an arrow. One of the three rollers 51 also serves as a bias roller for applying a given bias for image transfer (primary transfer bias) to the intermediate image-transfer member 50. A cleaner 90 having a cleaning blade for cleaning the intermediate image-transfer member 50 is arranged in the vicinity of the intermediate image-transfer member 50. A transferring roller 80 as the transferring unit faces the intermediate image-transfer member 50 and is capable of applying a bias for image transfer for transferring (secondary transferring) of a developed image (toner image) to a transferring sheet 95 serving as a final transferring member. A corona charger 58 for applying charges onto the developed image on the intermediate image-transfer member 50 is arranged around the intermediate image-transfer member 50. The corona charger 58 is disposed between a contact area of the photoconductor 10 and the intermediate image-transfer member 50 and another contact area of the intermediate image-transfer member 50 and the transferring sheet 95 in the direction of rotation of the intermediate image-transfer member 50.

The image developer 40 includes a developing belt 41 as a developer carrier, a black developing unit 45K disposed around the developing belt 41, a yellow developing unit 45Y, a magenta developing unit 45M, and a cyan developing unit 45C. The black developing unit 45K includes a developer tank 42K, a developer feed roller 43Y, and a developing roller 44Y. The yellow developing unit 45Y includes a developer tank 42Y, a developing feed roller 43Y, and a developing roller 44Y. The magenta developing unit 45M includes a developer tank 42M, a developer feed roller 43M, and a developing roller 44M. The cyan developing unit 45 includes a developer tank 42C, a developer feed roller 43C, and a developing roller 44C. The developing belt 41 is in the form of an endless belt and is rotatably spanned over plural belt rollers, a part of which is in contact with the photoconductor 10.

Figure 9:
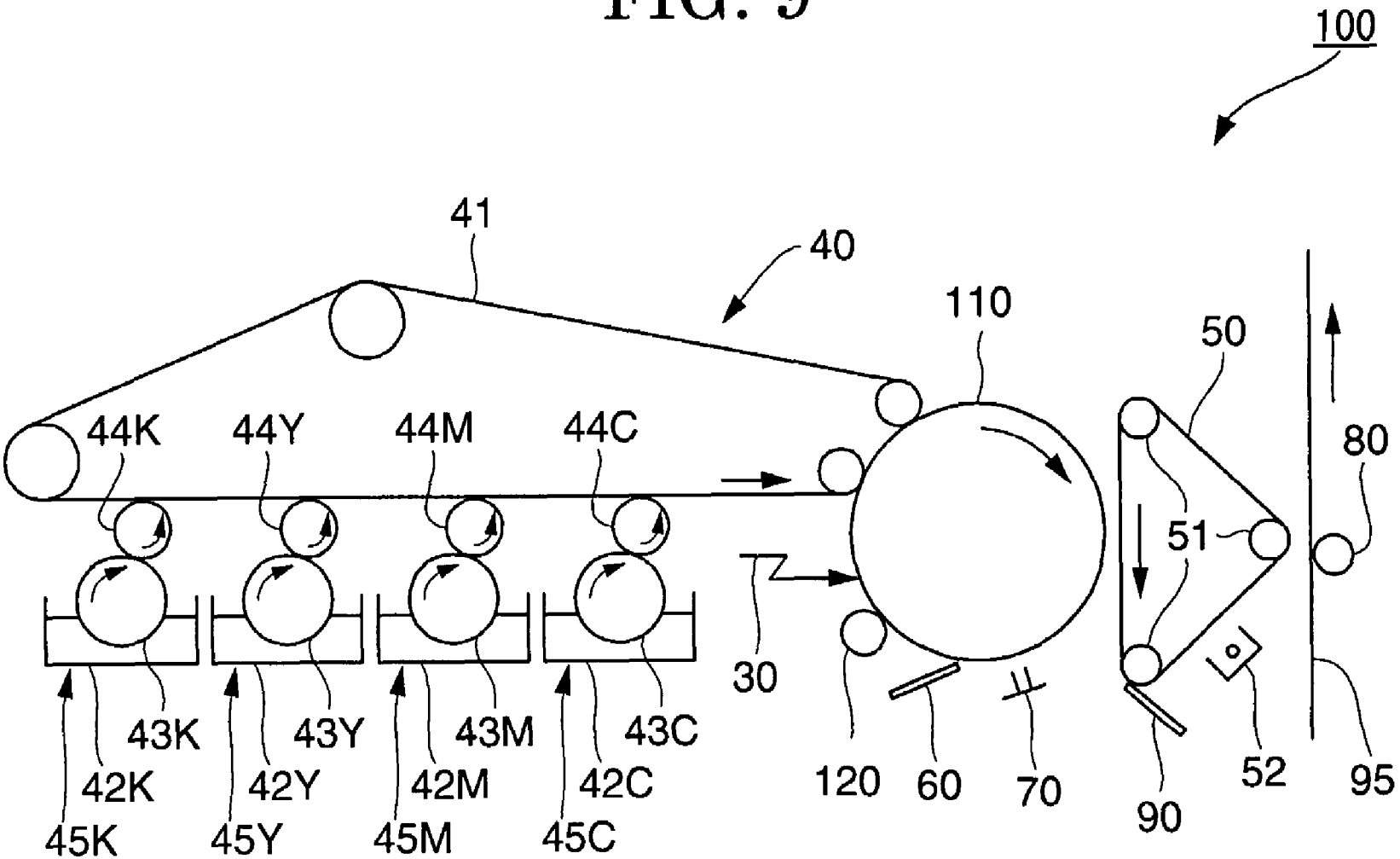
FIG. 9 is a schematic view showing an example of executing the image forming process of the present invention by means of the image forming apparatus according to the present invention.

Is in the image forming apparatus shown in FIG. 9, for instance, the charge roller 20 uniformly charges the photoconductor drum 10. The exposer 30 exposes the photoconductor drum 10 imagewise to form a electrostatic latent image thereon. The image developer 40 feeds the toner to the photoconductor drum 10 to develop the electrostatic latent image thereon to thereby form a visible image toner image). The visible image (toner image) is transferred to the intermediate image-transfer member (primary transferring) and then transferred to the transferring sheet 95 (secondary transferring) by action of a voltage applied by the rollers 51, to thereby form a transferred image on the transferring sheet 95. Untransferred toner on the photoconductor 10 after the transferring procedure are removed by the cleaner 60, followed by elimination of residual charges on the photoconductor 10 by the charge-eliminating lamp 70.

Figure 10:
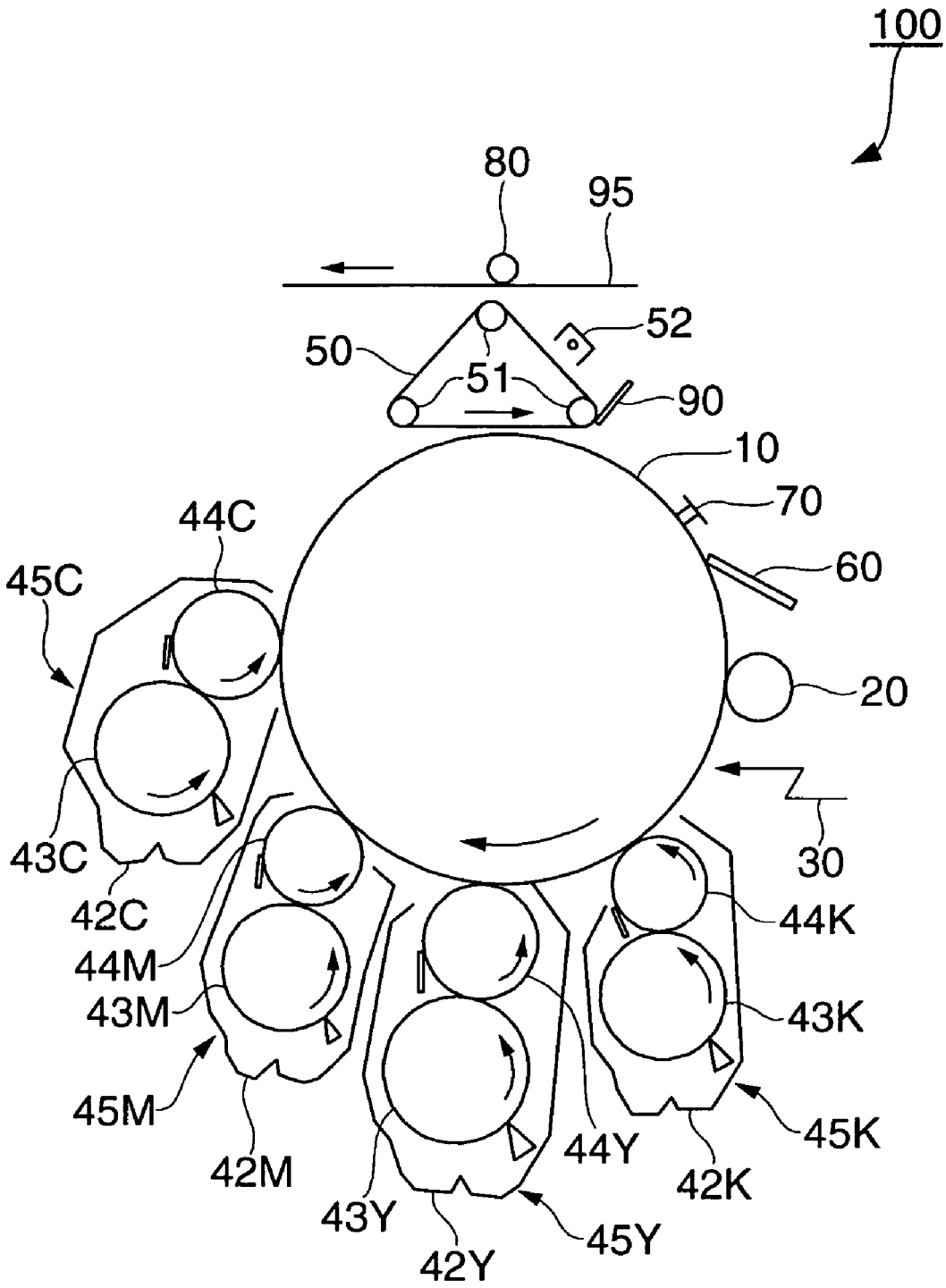
FIG. 10 is another schematic view showing an example of executing the image forming process of the present invention by means of the image forming apparatus according to the present invention.

Another aspect of the image forming process using the image forming apparatus will be illustrated with reference to FIG. 10. The image forming apparatus 100 shown in FIG. 10 has the same configuration and the same advantages as in the image forming apparatus 100 shown in FIG. 9 except that the image forming apparatus 100 of FIG. 10 does not include a developing belt 41, and that a black developing unit 45K, a yellow developing unit 45Y, a magenta developing unit 45M, and a cyan developing unit 45C surround and face a photoconductor 10. The same components of FIG. 10 as those of FIG. 9 have the same reference numerals, respectively.

Figure 11:
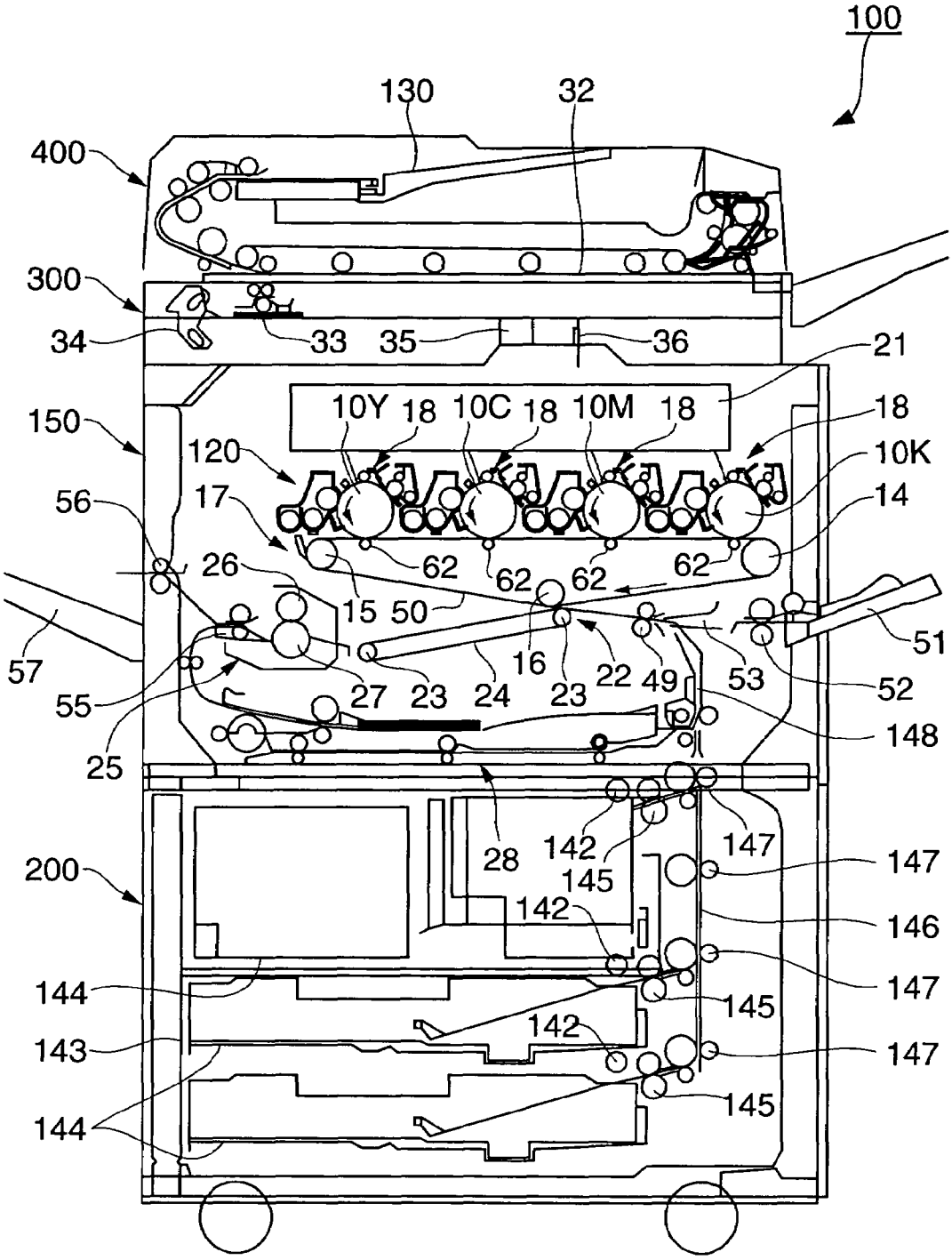
FIG. 11 is further a schematic view showing an example of executing the image forming process of the present invention by means of the image forming apparatus according to the present invention (a tandem color image forming apparatus).

Another aspect of the image forming process using the image forming apparatus will be illustrated with reference to FIG. 11. The image forming apparatus 100 shown in FIG. 11 is a tandem color image forming apparatus which includes a copier main body 150, sheet feeder table 200, a scanner 300, and automatic document feeder (ADF) 400.

The copier main body 150 includes an endless belt intermediate image-transfer member 50 at its center part. The intermediate image-transfer member 50 is spanned over three support rollers 14, 15, and 16 is capable of rotating and moving in a clockwise direction in FIG. 11. An intermediate image-transfer member cleaner 17 is capable of removing a residual toner from the intermediate image-transfer member 50 after image transfer and is arranged in the vicinity of the support roller 15. Above the intermediate image-transfer member 50 spanned between the first and second support rollers of 14 and 15, yellow, cyan, magenta, and black image forming devices 18 are arrayed in parallel in a moving direction of the intermediate image-transfer member 50 to thereby constitute a tandem image forming a tandem image forming unit 120. A exposer 21 is arranged in the vicinity of the tandem image forming unit 120. A secondary image transferer 22 faces the tandem image developer 120 with the interposition of the intermediate image-transfer member 50. The secondary transferer 22 comprises an endless belt serving as a secondary transferring belt 24 spanned over a pair of rollers 23. The transferring sheet transported in the vicinity of the secondary transferring belt 24 is capable of being in contact with the intermediate image-transfer member 50. An image-fixer is arranged on the side of the secondary image-transferer 22. The image-fixer 25 comprises a heat roller 26 and a pressure roller 27 pressed on by the heat roller 26.

The tandem image forming apparatus 100 further includes a sheet reverser 28 in the vicinity of the secondary image-transferer 22 and the image-fixer 25. The sheet reverser 28 is capable of reversing the transferring sheet so as to form images on both sides of the transferring sheet.

A full-color image (color copy) is formed by using the tandem image forming apparatus 100 in the following manner. Initially, a document is placed on a document platen 130 of the automatic document feeder (ADF) 400. Alternatively, the automatic document feeder (ADF) 400 is opened, a document is placed on a contact glass 32 of the scanner 300, and the automatic document feeder (ADF) 400 is closed to press the document.

Figure 12:
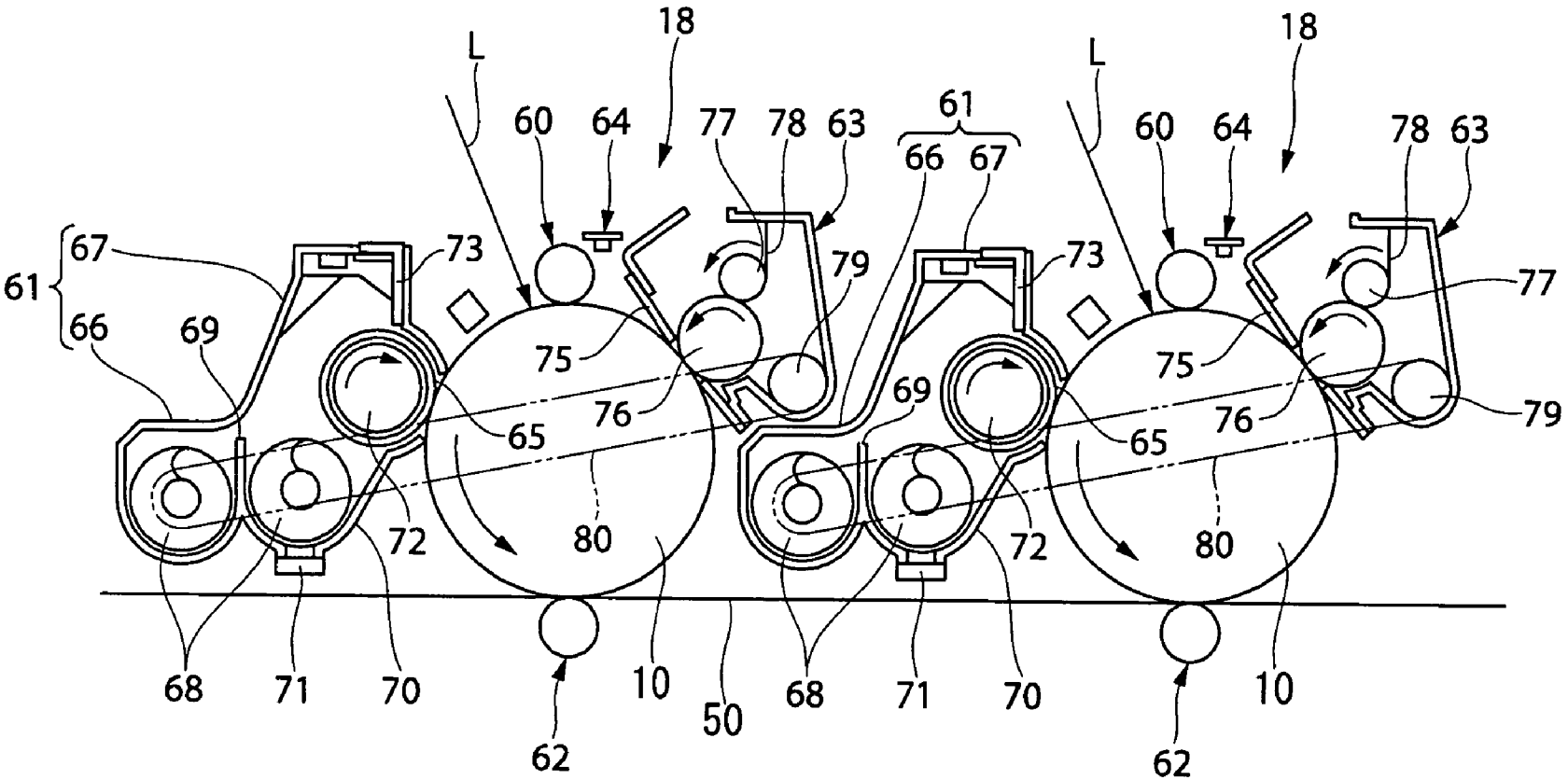
FIG. 12 is a schematic view showing an expanded portion of the image forming apparatus illustrated in FIG. 11.

When pushing a starting switch (not shown), the document placed on the automatic document feeder 400 is transported onto the contact glass 32. When the document is initially place on the contact glass 32, the scanner 300 is immediately driven to operate a first carriage 33 and a second carriage 34. Light is applied from a light source to the document by action of the first carriage 33, and reflected secondary from the document is further reflected toward the second carriage 34. The reflected light is further reflected by a mirror of the second carriage 34 and passes through an image-forming lens 35 into a read sensor 36 to thereby read the color document (color image) and to produce black, yellow, magenta, and cyan image information. Each of the black, yellow, magenta, and cyan image information is transmitted to each of the image forming devices 18 (black, yellow, magenta, and cyan image forming devices) in the tandem image forming apparatus 100 to thereby form black, yellow, magenta, and cyan toner image therein. Specifically, each of the image forming devices 18 (black, yellow, magenta, and cyan image forming devices) in the tandem image forming apparatus 100 has, as shown FIG. 12, a photoconductor 10 (black photoconductor 10K, yellow photoconductor 10Y, magenta photoconductor 10M, and cyan photoconductor 10C), an electrostatic charger 60 used to charge the photoconductor evenly, a exposer, an image-developer 61, a transferring charger 62, a electrostatic latent image carrier cleaner 63, and a charge-eliminator 64 and can form a monochrome image (black, yellow, magenta, and cyan image) based on the color image information. The charger 60 serves to charge the electrostatic latent image carrier uniformly. The exposer exposes the electrostatic latent image carrier color-imagewise (indicated by L in FIG. 12) based on each color image information to thereby form a electrostatic latent image corresponding to each individual color image on the photoconductor 10. The image-developer 61 develops the electrostatic latent image with a color developer (black, yellow, magenta or cyan toner) to thereby form a visible image. The transferring charger 62 transfers the visible image to the intermediate image-transfer member 50. The black image formed on the black photoconductor 10K, the yellow image formed on the yellow photoconductor 10Y, the magenta image formed on the magenta photoconductor 10M, and the cyan image formed on the cyan photoconductor 10C are sequentially transferred (primary transferring) and superimposed onto the intermediate image-transfer member 50 rotated and shifted by the support rollers 14, 15, and 16. Thus, a composite color image (transferred color image) is formed.

One of feeder rollers 142 of the feeder table 200 is selectively rotated, sheets (recording papers) are ejected from one of multiple feeder cassettes 144 in a paper bank 143 and are separated by a separation roller 145 one by one into a feeder path 146, and are transported by a transport roller 147 into a feeder path 148 in the copier main body 150 and are bumped against a resist roller 49. Alternatively, a feeder roller 150 is rotated to eject sheets (recording papers) on a manual bypass tray 51, the sheets are separated one by one by a separation roller 52 into a manual bypass feeder path 53 and are bumped against the resist roller 49. The resist roller 49 is generally grounded but can be used under the application of a bias to remove paper dust of the sheets.

The resist roller 49 is rotated in synchronization with the movement of the composite color image (transferred color image) on the intermediate image-transfer member 50 to transport the sheet (recording paper) into between the intermediate image-transfer member 50 and the secondary image-transferer 22, and the composite color image (transferred color image) is transferred onto the sheet by action of the secondary image-transferer 22 (secondary transferring) to thereby transfer the color image to the recording paper. Separately, the intermediate image-transfer member cleaner 17 removes residual developers on the intermediate image-transfer member 50 after image transfer.

The sheet (recording paper) bearing the transferred color image is transported by the secondary image-transferer 22 into the image-fixer 25, is applied with heat and pressure in the image-fixer 25 to fix the composite color image (transferred color image) on the sheet (recording paper). The sheet then changes its direction by action of a switch blade 55 and ejected by an ejecting roller 56 to be stacked on an output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 and then stacked onto the output tray 57.

The image forming apparatus and the image forming process in accordance with the present invention makes it possible to efficiently obtain high quality images even under low-temperature fixing conditions, because the toner of the present invention which can achieve a balance between balancing blocking resistivity and low-temperature fixability and has excellent hot-offset resistivity is used therein.

Hereafter, the present invention will be described referring to specific examples; however, the present invention is not limited to the disclosed examples. On the contrary, the present invention is intended to cover various modifications and equivalent arrangements included within the spirit and scope of the appended claims.

Resins 1 through 14 were prepared for materials for forming the toner of the present invention. Tables 1 and 2 show the compositions and the physical properties of the prepared resins 1 through 14.

Tables 1 and 2 show the presence of powder x-ray diffracted peak measured by an x-ray diffractometer ("PINT-1100"; manufactured by Rigaku Corp.) and the presence and absence of the powder x-ray diffracted peak based on the following criteria:

[Evaluation Criteria]

Presence: An x-ray diffracted peak exists at $2\theta=20°$ to $25°$.

Absence: An x-ray diffracted peak does not exist at $2\theta=20°$ to $25°$.

TABLE 1

| | Composition | | With or Without Powder x-ray | Tg (tangent | Melting |
|---|---|---|---|---|---|
| | Acid Components | Alcohol Components | diffracted peak | intersection point) ° C. | point ° C. |
| Resin 1 | Terephthalic acid, Malonic acid | Ethylene glycol, 1,4-butanediol | With | 65 | 75 |
| Resin 2 | Fumaric acid, Adipic acid | Ethylene glycol, 1,6-hexanediol | With | 121 | 135 |
| Resin 3 | Terephthalic acid, Malonic acid | 1,4-cyclohexane dimethanol | Without | 69 | 75 |
| Resin 4 | Fumaric acid, Adipic acid | Ethylene glycol, 1,4-butanediol, 1,6-hexanediol | With | 110 | 127 |
| Resin 5 | Fumaric acid, Adipic acid | Ethylene glycol, 1,4-butanediol, 1,6-hexanediol | With | 96 | 115 |
| Resin 6 | Fumaric acid, Adipic acid, and Dodecenyl succinic acid | 1,4-butanediol, 1,6-hexanediol | With | 73 | 80 |

It is noted that the resins 1 through 6 in Table 1 are respectively a polyester resin which comprises a constitutional unit expressed by the above formula (1).

TABLE 2

| | Resin | With or Without Powder x-ray diffracted peak | Tg (tangent intersection point) (° C.) | F ½ Temperature (° C.) | THF Insoluble amount (% by weight) |
|---|---|---|---|---|---|
| Resin 7 | Styrene/Methyl acrylate copolymer resin | Without | 65 | 165 | None |
| Resin 8 | Polyester resin<br>Acid Components (Terephthalic acid, Anhydrous trimellitic acid)<br>Alcohol Components (BPA-EO, BPA-PO) | Without | 66 | 167 | 1 |
| Resin 9 | Polyester resin<br>Acid Components (Fumaric acid, Terephthalic acid, Anhydrous trimellitic acid)<br>Alcohol Components (BPA-PO) | Without | 70 | 158 | 5 |
| Resin 10 | Polyester resin<br>Acid Components (Terephthalic acid, Fumaric acid)<br>Alcohol Components (BPA-EO, BPA-PO) | Without | 65 | 92 | None |
| Resin 11 | Polyester resin<br>Acid Components (Fumaric acid, anhydrous trimellitic acid)<br>Alcohol Components (BPA-EO, BPA-PO) | Without | 60 | 143 | 11 |
| Resin 12 | Polyester resin<br>Acid Components (Fumaric acid, Terephthalic acid, Anhydrous trimellitic acid)<br>Alcohol Components (BPA-EO, BPA-PO) | Without | 65 | 152 | 28 |
| Resin 13 | Styrene/Acrylonitrile/Butyl methacrylate copolymer resin | Without | 65 | 140 | 14 |
| Resin 14 | Polyester resin<br>Acid Components (Terephthalic acid, Anhydrous trimellitic acid)<br>Alcohol Components (BPA-EO, BPA-PO) | Without | 65 | 132 | 0 |

In Table 2, BPA-EO is a bisphenol A ethylene oxide adduct, and BPA-PO is a bisphenol A propylene oxide adduct.

EXAMPLE 1

Preparation of Toner

A toner was prepared based on the following composition:

| | |
|---|---|
| Resin 1 | 60 parts by mass |
| Resin 7 | 40 parts by mass |
| Carbon black | 10 parts by mass |
| Polyethylene wax (melting point: 95° C.) | 5 parts by mass |
| Iron-salicylate | 1 part by mass |

Materials for preparing a toner based on the above composition was input to a Henschel mixier ("MF20C/I Model;

manufactured by MITSUI MIIKE MACHINERY CO., LTD.) and sufficiently agitated and mixed and then kneaded by means of a twin screw extruder (manufactured by TOSHIBA MACHINE CO., LTD.), followed by cooling of the kneaded components.

Next, the cooled components were comminuted and classified so as to have the volume-averaged particle diameter of 9.5±0.5 μm to prepare a toner base. The kneading was performed by setting the twin screw extruder so that the temperature of the kneaded product at the exit of the extruder is approx. 120 ° C.

To the obtained toner base, 0.6% by mass of hydrophobic silica and 0.3% by mass of titanium oxide was added and mixed to prepare a toner for Example 1.

Preparation of Developer

Next, 4 parts by mass of the obtained toner and 96 part by mass of silicone coat ferrite carrier which is coated with a silicone resin having the average particle diameter of 45 μm were agitated using a turbular mixer to prepare a developer having a suitable amount of electrostatic charge.

Fixing Step

Through the use of an image forming apparatus in which the fixing section of a copier manufactured by Ricoh Co., Ltd. (IMAGIO NE0350) was remodeled such that the fixing temperature can be changed by the image-fixer, a toner image T was formed by using the toner and the developer obtained in Example 1 and fixed on a recording medium S ("Type6200"; manufactured by Ricoh Co., Ltd., with a smoothness level of 40 sec to 55 sec).

The image fixer 1 includes a heat roller 2 and a pressure roller 3, which is brought into pressure contact with the heat roller 2.

The heat roller 2 includes a metallic cylinder 4 of which the surface thereof is coated with an offset preventing layer 5 and provides a heat lamp 6 inside.

A heat roller 3 includes a metallic cylinder 7 of which the surface thereof is coated with an offset preventing layer 8. The heat roller 3 may be designed to house a heat lamp 9 inside.

The heat roller 2 and the pressure roller 3 are rotatably provided so that the pressure roller 3 is pressed and urged in contact with the heat roller 2 by means of a spring (not shown).

First, a recording medium (sheet) S, on which a toner image T to be fixed is formed, is transported to the nip portion between the heat roller and the pressure roller. While the toner image T on the sheet S is heated by the heat roller 2 and the pressure roller 3 which are heated to a predetermined temperature by action of the built-in heat lamp 6 becomes a molten state, the toner image T is pressed by the pushing force of the pressure roller 3 when passing through the nip portion to thereby fix the toner image T on the sheet S.

(Fixing Condition 1) The fixing was performed based on the fixing condition (1): An image fixer shown in FIG. 1 was used for fixing with a contact bearing stress between a heat roller and a pressure roller of $2.5\times10^5$ Pa, a linear velocity of 180 mm/sec.

The heat roller 2 is a roller which includes a cylinder made from SUS having a thickness of 3.0 mm with a PTFE layer having a thickness of 20 μm coated thereon. The pressure roller 3 is a roller which includes a cylinder made from SUS having a thickness of 2.0 mm with a silicone rubber layer having a thickness of 4 μm thereon with a PFA layer having a thickness of 50 μm coated on the surface on the silicone rubber layer.

EXAMPLE 2

A toner was prepared for Example 2 to execute a fixing step in the same manner as Example 1 except that the fixing condition (1) in the fixing step was substituted for the following fixing condition (2).

Fixing Step (Fixing Condition 2) A fixing was performed based on the fixing condition (2): An image fixer shown in FIG. 1 was used for fixing with a contact bearing stress between a heat roller and a pressure roller of $9.0\times10^4$Pa, a linear velocity of 180 mm/sec.

The heat roller 2 is a roller which comprises a cylinder made from aluminum having a thickness of 0.5 mm with a PTFE layer having a thickness of 16 μm coated thereon. The pressure roller 3 is a roller which comprises a cylinder made from aluminum having a thickness of 1.0 mm with a silicone rubber layer having a thickness of 3 μm thereon with a PFA layer having a thickness of 30 μm coated on the surface of the silicone rubber layer.

EXAMPLE 3

A toner was prepared for Example 3 to execute a fixing step in the same manner as Example 1 except that the toner composition was substituted for the following toner composition:

Composition of Toner

| | |
|---|---|
| Resin 2 | 60 parts by mass |
| Resin 7 | 40 parts by mass |
| Carbon black | 10 parts by mass |
| Polyethylene wax (melting point: 95° C.) | 5 parts by mass |
| Iron-salicylate | 1 part by mass |

EXAMPLE 4

A toner was prepared for Example 4 to execute a fixing step in the same manner as Example 3 except that the fixing condition (1) in the fixing step was substituted for the fixing condition (2) in the fixing step for Example 2.

EXAMPLE 5

A toner was prepared for Example 5 to execute a fixing step in the same manner as Example 3 except that Resin 8 was used instead of Resin 7 and the fixing condition in the fixing step was substituted for the fixing condition (2) in the fixing step for Example 2.

EXAMPLE 6

A toner was prepared for Example 6 to execute a fixing step in the same manner as Example 2 except that the toner composition was substituted for the following toner composition:

Composition of Toner

| | |
|---|---|
| Resin 4 | 50 parts by mass |
| Resin 8 | 50 parts by mass |
| Carbon black | 10 parts by mass |
| Polyethylene wax (melting point: 95° C.) | 5 parts by mass |
| Iron-salicylate | 1 part by mass |

EXAMPLE 7

A toner base was prepared in the same manner as Example 6 except that the kneaded and cooled components were comminuted and classified so as to have the volume-averaged particle diameter of 6.5±0.5 μm. Then, to execute the fixing step of Example 7, a toner for Example 7 was prepared in the same manner as Example 6 except that 1.0% by mass of hydrophobic silica and 0.5% by mass of titanium oxide was added to the obtained toner body and mixed.

EXAMPLE 8

A toner was prepared for Example 8 to execute a fixing step in the same manner as Example 7 except that the toner composition was substituted for the following toner composition:

Composition of Toner

| | |
|---|---|
| Resin 4 | 30 parts by mass |
| Resin 9 | 70 parts by mass |
| Carbon black | 10 parts by mass |
| Carnauba wax (melting point: 83° C.) | 5 parts by mass |
| Iron-salicylate | 1 part by mass |

EXAMPLE 9

A toner was prepared for Example 9 to execute a fixing step in the same manner as Example 7 except that the toner composition was substituted for the following toner composition:

Composition of Toner

| | |
|---|---|
| Resin 4 | 25 parts by mass |
| Resin 8 | 65 parts by mass |
| Resin 10 | 10 parts by mass |
| Carbon black | 10 parts by mass |
| Carnauba wax (melting point: 83° C.) | 5 parts by mass |
| Iron-salicylate | 1 part by mass |

EXAMPLE 10

A toner was prepared for Example 10 to execute a fixing step in the same manner as Example 7 except that the toner composition was substituted for the following toner composition:

Composition of Toner

| | |
|---|---|
| Resin 5 | 10 parts by mass |
| Resin 11 | 90 parts by mass |
| Carbon black | 10 parts by mass |
| Ester wax (melting point: 85° C.) | 5 parts by mass |
| Iron-salicylate | 1 part by mass |

EXAMPLE 11

A toner was prepared to execute a fixing step of Example 11 in the same manner as Example 7 except that the toner composition was substituted for the following toner composition:

Composition of Toner

| | |
|---|---|
| Resin 5 | 20 parts by mass |
| Resin 12 | 80 parts by mass |
| Carbon black | 10 parts by mass |
| Carnauba wax (melting point: 95° C.) | 5 parts by mass |
| Iron-salicylate | 1 part by mass |

EXAMPLE 12

A fixing step for Example 12 was executed through the use of the same toner for Example 11 and in the same manner as Example 11 except that the recording medium S in the fixing step was changed from "Type6200" (manufactured by Ricoh Co., Ltd., with a smoothness level of 40 to 55 sec)" to "OA paper" (manufactured by Ricoh Co., Ltd., with a smoothness level of 25sec to 30sec)".

EXAMPLE 13

A toner was prepared for respectively Example 13 and Example 14 to execute a fixing step in the same manner as Example 7 except that the toner composition is substituted for the following toner compositions:

Composition of Toner

| | |
|---|---|
| Resin 6 | 30 parts by mass |
| Resin 12 | 70 parts by mass |
| Carbon black | 10 parts by mass |
| Carnauba wax (melting point: 83° C.) | 5 parts by mass |
| Iron-salicylate | 1 part by mass |

EXAMPLE 14

Preparation of Toner

| | |
|---|---|
| Resin 5 | 15 parts by mass |
| Resin 14 | 85 parts by mass |
| Carbon black | 10 parts by mass |
| Carnauba wax (melting point: 83° C.) | 5 parts by mass |
| Zinc-salicylate | 0.8 part by mass |

Materials for preparing a toner based on the above composition were input to a Henschel mixier ("MF20C/I Model; manufactured by MITSUI MIIKE MACHINERY CO., LTD.) and sufficiently agitated and mixed and then kneaded by means of a twin screw extruder (manufactured by TOSHIBA MACHINE CO., LTD.), followed by cooling of the kneaded components. The cooled components were comminuted and classified so as to have the volume-averaged particle diameter of 6.5±0.5 μm to prepare a toner base. The kneading was performed by setting the twin screw extruder so that the temperature of the kneaded product at the exit of the extruder is approx. 100° C.

To the obtained toner base, 1.0% by mass of hydrophobic silica and 0.8% by mass of titanium oxide was added and mixed to prepare a toner for Example 14.

Next, using the obtained toner, a developer was prepared in the same manner as Example 1 to execute a fixing step in the same manner as Example 2.

EXAMPLE 15

Through the use of an image forming apparatus in which the fixing section of a copier manufactured by Ricoh Co., Ltd. (imagio Color 4000) was remodeled such that the fixing temperature can be changed to be the image-fixer shown in FIG. 2, a toner image T was formed by using the same toner and the same developer as in Example 14 to fix the toner image T on a recording medium S ("Type6200"; manufactured by Ricoh Co., Ltd.). (Fixing Condition 3) An image fixer shown in FIG. 2 was used to execute a fixing based on the fixing condition (3) with a bearing stress of the fixing nip portion N (nip width 10 mm) of $5\times10^4$ Pa, a linear velocity of 100 mm/sec.

A fixing belt that includes a heat generation layer made from a nickel belt having a thickness of 10 μm, an elastic material layer as an outer layer of the nickel belt (a silicone rubber with a thickness of 100 μm, JIS K-6301 with a hardness degree of 35°), and a demolding layer as an outer layer of the elastic material layer (a fluorocarbon resin having a thickness of 20 μm) was used. A pressure roller of which the cored bar made from SUS is coated with a fluorocarbon rubber to become the outer diameter of the pressure roller of 35 mm.

EXAMPLE 16

Through the use of an image forming apparatus in which the fixing section of a copier manufactured by Ricoh Co., Ltd. (imagio Color 4000) was remodeled such that the fixing temperature can be changed to be the image-fixer shown in FIG. 7, a toner image T was formed by using the same toner and the same developer as in Example 14 to fix the toner image T on a recording medium S ("Type 6200"; manufactured by Ricoh Co., Ltd.).

(Fixing Condition 4) An image fixer shown in FIG. 7 was used to execute a fixing based on the fixing condition (4) with a bearing stress of the fixing nip portion N (nip width 12 mm) of $8\times10^4$ Pa, a linear velocity of 125 mm/sec.

A heat roller made from nickel and having a hollow and cylindrical body shape, an outer diameter of 20 mm, and a wall thickness of 0.1 mm was used. A fixing roller which includes a cored bar made from SUS with a foam-like silicone rubber (Asker hardness: 50°) having a thickness of 5 mm coated as an elastic member on the cored bar so as to have an outer diameter of the fixing roller of 40 mm was used.

A pressure roller which includes a cored bar made from aluminum with a foam-like silicone rubber (Asker hardness: 60°) having a thickness of 5 mm coated as an elastic member on the cored bar so as to have an outer diameter of the pressure roller of 40 mm was used.

A fixing belt that includes a heat generation layer made from a nickel belt having a thickness of 10 μm and a demolding layer made from a fluorocarbon rubber having a thickness of 200 μm laminated on the heat generation layer was used.

REFERENCE EXAMPLE 17

A black toner and the developer were obtained in the same manner as Example 11 except that the toner constituent material of 1 part by mass of iron-salicylate in Example 11 was changed to 1 part by mass of zirconium salicylate.

An yellow toner and the developer were obtained in the same manner as in the above black toner except that 10 parts by mass of carbon black in the above constituent materials for black toner was changed to 7 parts by mass of disazo yellow pigment.

A cyan toner and the developer were obtained in the same manner as in the above black toner except that 10 parts by mass of carbon black in the above constituent materials for black toner was changed to 4 parts by mass of copper phthalocyanine blue pigment.

A magenta toner and the development were obtained in the same manner as in the above black toner except that 10 parts by mass of carbon black in the above constituent materials for black was changed to 5 parts by mass of a naphthol magenta pigment.

With the use of the above toners and developers and the same image forming apparatus as in Example 16, a two-color superimposed image of blue, green, and red was formed and fixed on a recording medium S (type 6000 70W; manufactured by Ricoh Co., Ltd.) by setting the fixing temperature at 180° C. Color measuring of a given portion of solid part was performed by using a spectrum colorimeter (manufactured by X-Rite, Inc.; 938 spectrum densitometer). Table 5 shows the results of color measuring. * In Table 5, L*, a* and b* respectively are values indicating a color in the color coordinate systems of L*, a* and b*. Specifically, L* indicates brightness of color, a* indicates hue, and b* indicates color saturation.

REFERENCE EXAMPLE 18

A black toner and the developer were obtained in the same manner as in the above black toner.

An yellow toner and the developer were obtained in the same manner as in the above black toner except that 10 parts by mass of carbon black in the above constituent materials for black toner was changed to 7 parts by mass of disazo yellow pigment.

A cyan toner and the developer were obtained in the same manner as in the above black toner except that 10 parts by mass of carbon black in the above constituent materials for black toner was changed to 4 parts by mass of copper phthalocyanine blue pigment.

A magenta toner and the development were obtained in the same manner as in the above black toner except that 10 parts by mass of carbon black in the above constituent materials for black was changed to 5 parts by mass of a naphthol magenta pigment.

A two-color superimposed image was formed and fixed in the same manner as in Reference Example 17 except that the above toners and developers were used and the fixing temperature was set to 160° C. Then color measuring was performed in the same manner as Example 17. Table 5 shows the results of color measuring.

COMPARATIVE EXAMPLE 1

A toner was prepared for Comparative Example 1 to execute a fixing step in the same manner as Example 1 except that the toner composition was substituted for the following toner composition:

Composition of Toner

| | |
|---|---|
| Resin 3 | 50 parts by mass |
| Resin 8 | 50 parts by mass |
| Carbon black | 10 parts by mass |
| Polyethylene wax (melting point: 95° C.) | 5 parts by mass |
| Iron-salicylate | 1 part by mass |

COMPARATIVE EXAMPLE 2

A toner was prepared for Comparative Example 2 to execute a fixing step in the same manner as Comparative Example 1 except that the fixing condition (1) of the fixing step was substituted for the fixing condition (2) in the fixing step of Example 2.

COMPARATIVE EXAMPLE 3

A toner was prepared for Comparative Example 3 to execute a fixing step in the same manner as Example 7 except that the toner composition was substituted for the following toner composition:

Composition of Toner

| | |
|---|---|
| Resin 2 | 25 parts by mass |
| Resin 13 | 75 parts by mass |
| Carbon black | 10 parts by mass |
| Carnauba wax (melting point: 83° C.) | 5 parts by mass |
| Iron-salicylate | 1 part by mass |

COMPARATIVE EXAMPLE 4

A toner was prepared for Comparative Example 4 to execute a fixing step in the same manner as Comparative Example 3 except that the toner composition was substituted for the following toner composition:

Composition of Toner

| | |
|---|---|
| Resin 10 | 50 parts by mass |
| Resin 11 | 50 parts by mass |
| Carbon black | 10 parts by mass |
| Ester wax (melting point: 75° C.) | 20 parts by mass |
| Iron-salicylate | 1 part by mass |

COMPARATIVE EXAMPLE 5

A fixing step for Comparative Example 5 was executed through the use of the same toner of Comparative Example 4 and in the same manner as Comparative Example 4 except that the recording medium S in the fixing step was changed from "Type 6200" (manufactured by Ricoh Co., Ltd., with a smoothness level of 40 sec to 55 sec)" to "OA paper" (manufactured by Ricoh Co., Ltd., with a smoothness level of 25 sec to 30 sec)".

Table 3 shows respective partial compatibilities of the resins used in the above Examples 1 through 18 and Comparative Examples 1 through 5.

TABLE 3

| Crystalline Resin | Amorphous Resin | Mixed Resin product (Tg) | Presence of Endothermic action by crystalline resin source | Partial Compatibility |
|---|---|---|---|---|
| Resin 1 | Resin 7 | 63° C. | Yes | Yes |
| Resin 2 | Resin 7 | 63° C. | Yes | Yes |
| Resin 2 | Resin 8 | 63° C. | Yes | Yes |
| Resin 4 | Resin 8 | 60° C. | Yes | Yes |
| Resin 4 | Resin 9 | 62° C. | Yes | Yes |
| Resin 4 | Resin 10 | 57° C. | Yes | Yes |
| Resin 5 | Resin 11 | 49° C. | Yes | Yes |
| Resin 5 | Resin 12 | 58° C. | Yes | Yes |
| Resin 6 | Resin 12 | 57° C. | Yes | Yes |
| Resin 2 | Resin 13 | 64° C. | Yes | No |
| Resin 5 | Resin 14 | 58° C. | Yes | Yes |

With respect to the toners prepared in Examples 1 through 16 and Comparative Examples 1 through 5, the glass-transition temperature of the toner (TgA) was measured respectively according to the following process. In addition, the blocking resistivity was evaluated based on the following process. Table 4 shows the results. The value of TgC calculated with the equation (1) below will be also provided in Table 4.

$$TgC = \sum_{i=1}^{n} b_i \Big/ \sum_{i=1}^{n} \left( \frac{b_i}{TgB_i} \right) \qquad \text{Equation (1)}$$

<Measurement of Glass-Transition Temperature (TgA) >

The toners prepared for the above mentioned Examples and Comparative Examples were respectively heated at a temperature rising rate of 10° C./min from 20° C. to 150° C., by using a differential scanning calorimeter (such as "DSC-60"; manufactured by SHIMADZU Corp.), and then without retention time cooled down to the measurement starting temperature at the temperature decreasing rate of 10° C./min, followed by measurement at a temperature rising rate of 10° C./min. The glass-transition temperature of the toner (TgA)

was obtained by means of the tangent line method at the time when the toner temperature increased for the first time after being subjected to all the above steps.

<Blocking Resistivity >

Approx. 20 grams of the toners obtained in the above mentioned Examples and Comparative Examples were respectively put into a glass bottle of 20 ml and subjected to 50 times of tapping and then hardened up densely. The hardened toners were put into a temperature-controlled bath set at 50° and left intact for 24 hours, followed by measuring of the penetration rate (%) of toners in accordance with the penetration test (JIS K2235-1991). The blocking resistivity was evaluated based on the penetration rate (%) of the densely hardened toners.

[Evaluation Criteria]
5: 90% to 100%
4: 75% to 90%
3: 60% to 75%
2: 30% to 60%
1: 30% or less When the penetration rate (%) of the densely hardened toner applies to the evaluation criteria of 3 to 5, it is recognized that there is no problem with the blocking resistivity of the toner.

With respect to the toners prepared in Examples 1 through 16 and Comparative Examples 1 through 5, evaluations on fixability (low-temperature fixability and hot-offset resistivity), image density, background smear, smears through toner scattering, and thin-line reproductivity were carried out. Table 4 shows the results.

<Fixability >

In the Examples and Comparative Examples, the fixing temperature of toner in the respective fixing steps was changed and measured the cold-offset occurrence temperature and the hot-offset occurrence temperature in accordance with the following process. The toners were respectively evaluated as to the low-temperature fixability (cold-offset occurrence temperature) and the hot-offset resistivity (hot-offset occurrence temperature) based on the evaluation criteria below.

Measuring Process

The offset occurrence temperature was measured by using an image forming apparatus in which the fixing section of a copier (IMAGIO NEO 350 manufactured by Ricoh Co., Ltd.) was remodeled to the image-fixer shown in FIG. 1. Thus, a black solid image was formed on a transferring sheet ("Type6200"; manufactured by Ricoh Co., Ltd.) by using a copier ("IMAGIO NEO 350 manufactured by Ricoh Co., Ltd.). The obtained image was fixed on the transferring sheet using the image-fixer shown in FIG. 1 while changing the temperature of the heat roller and measured the fixing temperature at which an offset occurred (offset occurrence temperature). It is noted that in the evaluation of hot-offset resistivity, strict condition was place on hot-offset occurrences by setting the linear velocity at the time of sheet feeding at 50 mm/sec.

Evaluation Process

Low-Temperature Fixability (Cold-Offset Resistance)

From the obtained cold-offset occurrence temperature, the low-temperature fixability was evaluated in accordance with the following criteria:

[Evaluation Criteria]
5: Less than 120° C.
4: 120° C. to 130° C.
3: 130° C. to 140° C.
2: 140° C. to 150° C.
1: 150° C. or more Here, a toner having the low-temperature fixability on the conventional toner's level is applicable to the evaluation criterion 2. When the cold-offset occurrence temperature of the toner applies to the evaluation criteria 3 to 5, it is recognized that the low-temperature fixability of the toner is good.

Hot-Offset Resistivity

From the obtained hot-offset occurrence temperature, the hot-offset resistivity was evaluated in accordance with the following criteria:

[Evaluation Criteria]
5: 210° C. or more
4: 200° C. to 210° C.
3: 190° C. to 200° C.
2: 180° C. to 190° C.
1: Less than 180° C.

When the hot-offset occurrence temperature of the toner applies to the evaluation criteria 3 to 5, it is recognized that the hot-offset resistivity of the toner is good.

<Image Density >

A black solid image was formed on a transferring sheet ("Type 6200"; manufactured by Ricoh Co., Ltd.) by using a color image forming apparatus ("Imagio Color 4000" manufactured by Ricoh Co., Ltd.). With respect to the obtained image, six positions were selected at random to measure the individual image densities of the positions through the use of a spectrometer ("938 Spectrodensitometer"; manufactured by X-Rite, Inc.). From the obtained average value of the six positions, the image density was evaluated in accordance with the following criteria. It should be noted that this evaluation applies to the examples for the toner container, the process cartridge, the image forming apparatus, and the image forming process of the present invention.

[Evaluation Criteria]
5: 1.5 or more
4: 1.45 to 1.5
3: 1.40 to 1.45
2: 1.35 to 1.40
1: Less than 1.35

Here, when it applies to any of the evaluation criteria 1, it is recognized that it is possible to obtain an excellent image density.

<Background Smear >

After the output of 1,000,000 sheets, a white solid image was output to a transferring sheet ("Type 6200"; manufactured by Ricoh Co., Ltd.) by using a copier ("IMAGIO NE0350"; manufactured by Ricoh Co., Ltd.). With respect to the obtained image, six positions were selected at random to measure the individual image densities of the positions through the use of a spectrometer ("938 Spectrodensitometer"; manufactured by X-Rite, Inc.). From the obtained average value of the six positions, the background smear of the image was evaluated in accordance with the following criteria.

[Evaluation Criteria]
5: Same as the reflection density of the sheet
4: The reflection density of the sheet+less than 0.02
3: The reflection density of the sheet+0.02 to 0.04
2: The reflection density of the sheet+0.04 to 0.06
1: The reflection density of the sheet+0.06 or more Here, it is recognized that in the conditions where there is no background smear of the image, the reflection density of the image indicates a value equivalent to the reflection density of the sheet, and the larger the reflection density becomes, the worse the result of background smear of the image becomes.

<Toner Scattering >

After the output of 1,000,000 sheets, an image was output to a transferring sheet ("Type 6200"; manufactured by Ricoh Co., Ltd.) by using a copier ("IMAGIO NE0350" manufactured by Ricoh Co., Ltd.), the state of smears through toner scattering inside of the copier was evaluated in accordance with the following criteria:

[Evaluation Criteria]
5: Excellent
4: Good
3: Passable
2: Poor
1: Very poor

When it applies to any of the evaluation criteria 3 to 5, it is recognized that the toner scattering is on the level where the toner scattering will never become problematic.

<Thin-Line Productivity >

A one-dot lattice line image was output at 600dot/inch and 150 dot/inch in the directions of the primary scanning and the secondary scanning by using a copier ("IMAGIO NEO 350"; manufactured by Ricoh Co., Ltd.) to inspect visually breakages and thin spots of the line image. The result was evaluated in accordance with the following criteria:

[Evaluation Criteria]
5: Excellent
4: Good
3: Passable
2: Poor
1: Very poor

TABLE 5

| | | L* | a* | b* |
|---|---|---|---|---|
| Example 17 | Red | 44.2 | 62.7 | 44.1 |
| | Blue | 16.8 | 18.1 | −39.0 |
| | Green | 40.4 | −59.8 | 20.0 |
| Example 18 | Red | 44.4 | 65.1 | 44.3 |
| | Blue | 20.1 | 21.1 | −39.8 |
| | Green | 43.6 | −60.8 | 23.2 |

Based on the results shown in Tables 1 through 5, it is exemplified that the toners prepared in Examples 1 through 12 excel in low-temperature fixability, hot-offset resistivity, and blocking resistivity and enable obtaining high-quality images.

Example 1 exemplifies that a combination with a resin having a partial compatibility enables more favorable low-temperature fixability more than in conventional toners.

Example 2 exemplifies that the fixing at lower temperature compared to Example 1 can be obtained through fixing by means of a fixing apparatus with decreased thermal loss.

Example 3 exemplifies that the use of a straight-chain crystalline polyester resin (Resin 2) improves the sharp melt properties and makes it possible to obtain a toner having excellent low-temperature fixability, although the polyester resin has a high melting point.

Example 5 exemplifies that the use of a polyester resin (Resin 8) as an amorphous resin realized a toner that is superior to the toners in Examples 1 through 4 in low-temperature fixability.

Example 6 exemplifies that a toner having excellent low-temperature fixability and blocking resistivity was realized and the quality of an image formed using the toner was enhanced, although the content of a crystalline resin was

TABLE 4

| | Toner glass-transition Temperature (TgA) (° C.) | (TgC) value calculated based on Formula (1) (° C.) | Endothermic action from crystalline resin source | Fixing Condition | Low-temperature Fixability | Hot-offset Resistivity | Blocking Resistivity | Image Concentration | Back-ground smear | Toner scat-tering | Thin-line Reproduc-tivity |
|---|---|---|---|---|---|---|---|---|---|---|---|
| Ex. 1 | 63 | 65 | Yes | (1) | 2 | 4 | 5 | 3 | 3 | 3 | 3 |
| Ex. 2 | 63 | 65 | Yes | (2) | 3 | 4 | 5 | 3 | 3 | 3 | 3 |
| Ex. 3 | 63 | 65 | Yes | (1) | 2 | 4 | 5 | 4 | 3 | 3 | 3 |
| Ex. 4 | 63 | 65 | Yes | (2) | 3 | 4 | 5 | 4 | 3 | 3 | 3 |
| Compara. Ex. 1 | 67 | 67.5 | No | (1) | 1 | 4 | 4 | 5 | 5 | 5 | 4 |
| Compara. Ex. 2 | 67 | 67.5 | No | (2) | 1 | 4 | 4 | 5 | 5 | 5 | 4 |
| Ex. 5 | 60 | 66 | Yes | (2) | 4 | 4 | 5 | 4 | 3 | 3 | 3 |
| Ex. 6 | 58 | 66 | Yes | (2) | 4 | 4 | 5 | 4 | 4 | 4 | 3 |
| Ex. 7 | 58 | 66 | Yes | (2) | 4 | 4 | 5 | 4 | 4 | 4 | 4 |
| Ex. 8 | 52 | 70 | Yes | (2) | 5 | 4 | 5 | 5 | 5 | 5 | 5 |
| Ex. 9 | 49 | 65.9 | Yes | (2) | 5 | 4 | 5 | 5 | 5 | 5 | 5 |
| Ex. 10 | 53 | 60 | Yes | (2) | 4 | 5 | 5 | 5 | 5 | 5 | 5 |
| Ex. 11 | 45 | 65 | Yes | (2) | 5 | 5 | 5 | 5 | 5 | 5 | 5 |
| Ex. 12 | 39 | 65 | Yes | (2) | 5 | 4 | 5 | 5 | 5 | 5 | 5 |
| Compara. Ex. 3 | 65 | 65 | Yes | (2) | 1 | 4 | 5 | 4 | 4 | 4 | 5 |
| Compara. Ex. 4 | 54 | 62.4 | No | (2) | 4 | 3 | 1 | 3 | 1 | 2 | 2 |
| Ex. 13 | Same as Ex. 11 | | | (2) | 5 | 5 | Same as Ex. 11 | | | | |
| Compara. Ex. 5 | Same as Compara. Ex. 4 | | | (2) | 2 | 3 | Same as Compara. Ex. 4 | | | | |
| Ex. 14 | 47 | 65 | Yes | (2) | 5 | 3 | 4 | 5 | 4 | 5 | 5 |
| Ex. 15 | Same as Ex. 14 | | | (3) | 5 | 4 | Same as Ex. 14 | | | | |
| Ex. 16 | Same as Ex. 14 | | | (4) | 5 | 4 | Same as Ex. 14 | | | | |

lessened, since the crystalline resin having a melting point lower than in Example 5 was used in this example.

Example 7 exemplifies that there is no degradation by fog in the image quality even if the volume-averaged particle diameter of a toner to be formed is scaled down, and the toner excels in thin-line reproductivity. In addition, there was no contamination by toner scattering inside the copier.

Examples 8 and 9 exemplify that the compatibility between the crystalline resin and the amorphous resin was enhanced by using the crystalline resin (Resin 4) and the amorphous resin (Resin 9 or Resin 10) containing a fumaric acid, which made the glass-transition temperature of the toner (TgA) lower and made it possible to obtain a toner having excellent low-temperature fixability, although the content of the crystalline resin was lesser than in Examples 1 through 7. Besides, in Example 8 an increase in the lower limit fixing temperature through cold-offset was not seen, since the melting point of the wax used was low.

Example 10 verifies that a toner that remarkably excels in not only low-temperature fixability but also hot-offset resistivity and blocking resistivity can be obtained when an insoluble portion of THF in an amorphous resin is more than 10%.

Example 11 exemplifies that a toner of which the lower limit fixing temperature is low can be obtained by using a crystalline resin having a low temperature melting point. It is also verified that this toner has satisfactory offset resistance as well as very excellent blocking resistivity, because the amorphous resin has high THF insoluble proportion, although the lower limit fixing temperature is low.

Example 12 verifies that the melting point of a crystalline resin is preferably 80° C. or more, because the hot-offset occurrence temperature remarkably decreases relative to the contribution to low-temperature fixability when the melting point is less than 80° C.

Example 13 verifies that the toner of the present invention excels in low-temperature fixability and hot-offset resistivity even with a recording medium having a low smoothness degree.

Example 14 exemplifies that a toner that excels in low-temperature fixability can be obtained, because the glass-transition temperature (Tg) of the toner is easily lowered even with a combination of resins with no similar component included by setting the THF insoluble portion at less than 5% by mass.

Examples 15 and 16 exemplifies that low-temperature fixability and hot-offset resistivity are easily secured in a toner that has a little THF insoluble portion which is suitable for a full-color toner through the use of another image fixer of the present invention.

Example 18 exemplifies that a toner having excellent color-reproductivity can be obtained by setting the THF insoluble portion at less than 5% by mass.

Comparative Example 1 exemplifies that a combination of a pair of amorphous resins does not achieve the low-temperature fixability more than in conventional toners.

In Comparative Example 2, a fixing step was performed with the fixing condition (2), which facilitates low-temperature fixability, but the lower limit fixing temperature was high, like Comparative Example 1. Besides, it is also verified that the toner is inferior in sharp melt properties since the toner does not include any crystalline resins, and the low-temperature fixability cannot be obtained even with the use of an image fixer having a fixing roller having low contact bearing stress.

Comparative Example 3 exemplifies that although the toner contains a crystalline resin (Resin 2), the glass-transition temperature of the toner (TgA) is equivalent to the glass-transition temperature of an amorphous resin (TgB), and the toner is inferior in low-temperature fixability, because the amorphous resin is not compatible with the crystalline resin (see Table 3).

Comparative Example 4 exemplifies that the dispersibility of the toner constituents at the time of being melted and kneaded becomes insufficient because of a large amount of the content of a wax included therein, which leads to the inferior blocking resistivity and the impossibility of obtaining high-quality image, although the glass-transition temperature of the toner is low and the toner excels in low-temperature fixability.

Comparative Example 5 exemplifies that it is impossible to obtain low-temperature fixability with a recording medium having a low smoothness unless the crystalline polyester resin has sharp melt properties, even if the glass-transition temperature of the toner (TgA) is low.

The toner of the present invention is suitably used for high-quality image forming, because the toner excels in various properties such as charge properties, transferring properties, and fixability and has good hot-offset resistivity and capable of achieving a balance between blocking resistivity and low-temperature fixability. The developer using the toner of the present invention, the toner container, the process cartridge, the fixing process, the image forming apparatus, and the image forming process of the present invention are preferably used for high-quality image formations.

What is claimed is:

1. A toner comprising:

a first binder resin and a second binder resin, wherein the first binder resin is an amorphous resin, and the second binder resin is a crystalline resin, wherein the glass-transition temperature of the toner "TgA" is lower than the glass-transition temperature "TgC" expressed by the following equation (1):

$$TgC = \sum_{i=1}^{n} b_i \Big/ \sum_{i=1}^{n} \left( \frac{b_i}{TgB_i} \right) \qquad \text{Equation (1)}$$

wherein "$TgB_i$" represents the glass-transition temperature of the amorphous resin, "n" represents the number of amorphous resins, and "b" represents the content of the amorphous resin, the content of the amorphous resin is represented with part by mass.

2. The toner according to claim 1, wherein at least a part of the amorphous resin and a part of the crystalline resin are compatible each other.

3. The toner according to claim 1, wherein the glass-transition temperature "TgA" is 10° C. or more lower than the glass-transition temperature "TgC" expressed by the equation (1).

4. The toner according to claim 1, wherein an endothermic peak of the crystalline polyester origin exists on the endothermic curve of DSC (differential scanning calorimetry) of the toner.

5. The toner according to claim 1, wherein the crystalline resin is a polyester resin which comprises the constitutional unit expressed by the following formula (1):

$$[\text{—OOC—R—COO—}(CH_2)_n\text{—}] \qquad \text{Formula (1)}$$

wherein "R" represents a divalent hydrocarbon group having the number of carbons of 2 to 20, and "n" represents the number of the repeating units from 2 to 20.

6. The toner according to claim 5, wherein "R" in the above formula (1) is a divalent hydrocarbon group of straight chain unsaturated aliphatic series.

7. The toner according to claim 1, wherein the content of the crystalline resin in the binder resin is 50% by mass or less.

8. The toner according to claim 1, wherein the crystalline resin has a melting point of ranging from 80° C. to 130° C.

9. The toner according to claim 1, wherein the x-ray diffraction pattern of the crystalline resin based on a powder x-ray diffractometer comprises a diffraction peak at 2θ=20° C. to 25° C.

10. The toner according to claim 1, wherein the amorphous resin "TgB" has a glass-transition temperature of 40° C. to 70° C., and a softening point "F1/2" of 120° C. to 160° C.

11. The toner according to claim 1, wherein the amorphous resin comprises a polyester resin.

12. The toner according to claim 11, wherein the polyester resin in the amorphous resin comprises any one of a fumaric acid, maleic acid, and a succinic acid as a component.

13. The toner according to claim 4, wherein the amorphous resin and the crystalline resin respectively comprise a polyester resin, and both of the polyester resin in the crystalline resin and the polyester resin in the amorphous resin comprise any one of a fumaric acid, a maleic acid, and a succinic acid as a component.

14. The toner according to claim 11, wherein the content of tetrahydrofuran (THF) insoluble portion in the amorphous resin is 10% by mass or more.

15. The toner according to claim 11, wherein the polyester resin in the amorphous resin comprises an aromatic dicarboxylic acid as a component, and the content of tetrahydrofuran (THF) insoluble portion in the amorphous resin is 0% bay mass to 5% by mass.

16. The toner according to claim 4, wherein the amorphous resin and the crystalline resin comprise a polyester resin, the content of tetrahydrofuran (THF) insoluble portion in the polyester resin of the amorphous resin is 0% by mass to 5% by mass, and at least any one of the polyester resin in the crystalline resin and the polyester resin in the amorphous resin comprises an aromatic dicarboxylic acid as a component.

17. The toner according to claim 1, wherein the toner further comprises a releasant, wherein the releasant has a melting point of 70° C. to 90° C.

18. The toner according to claim 1, wherein the volume-averaged particle diameter of the toner is 2.5 μm to 7 μm.

19. The toner according to claim 1, wherein the toner further comprises any one of inorganic particles and resinic particles.

20. A developer comprising:

a toner, wherein the toner comprises a first binder resin and a second binder resin, wherein the first binder resin is an amorphous resin, and the second binder resin is a crystalline resin, wherein the glass-transition temperature of the toner "TgA" is lower than the glass-transition temperature "TgC" expressed by the following equation (1).

$$TgC = \sum_{i=1}^{n} b_i \Big/ \sum_{i=1}^{n} \left(\frac{b_i}{TgB_i}\right) \qquad \text{Equation (1)}$$

wherein "$TgB_i$" represents the glass-transition temperature of the amorphous resin, "n" represents the number of amorphous resins, and "b" represents the content of the amorphous resin, the content of the amorphous resin is represented with part by mass.

21. A toner container, containing a toner, wherein the toner comprises a first binder resin and a second binder resin, wherein the first binder resin is an amorphous resin and the second binder resin is a crystalline resin, wherein the glass-transition temperature "TgA" of the toner is lower than the glass-transition temperature "TgC" expressed by the following equation (1)

$$TgC = \sum_{i=1}^{n} b_i \Big/ \sum_{i=1}^{n} \left(\frac{b_i}{TgB_i}\right) \qquad \text{Equation (1)}$$

wherein "TgBi" represents the glass-transition temperature of the amorphous resin, n represents the number of amorphous resins, and "b" represents the content of the amorphous resin, the content of the amorphous resin is represented with part by mass.

22. A process cartridge comprising:

an electrostatic latent image carrier, and a developing unit, wherein the developing unit is containing a toner and serving for developing an electrostatic latent image formed on the electrostatic latent image carrier using the toner to form a visible image, wherein the toner comprises a first binder resin and a second binder resin, wherein the first binder resin is an amorphous resin, and the second binder resin is a crystalline resin, wherein the glass-transition temperature of the toner "TgA" is lower than the glass-transition temperature "TgC" expressed by the following equation (1):

$$TgC = \sum_{i=1}^{n} b_i \Big/ \sum_{i=1}^{n} \left(\frac{b_i}{TgB_i}\right) \qquad \text{Equation (1)}$$

wherein "TgBi" represents the glass-transition temperature of the amorphous resin, "n" represents the number of amorphous resins, and "b" represents the content of the amorphous resin, the content of the amorphous resin is represented with part by mass.

* * * * *